US011174116B2

(12) United States Patent
Sato et al.

(10) Patent No.: US 11,174,116 B2
(45) Date of Patent: Nov. 16, 2021

(54) SHEET-FEEDING SYSTEM AND SHEET-FEEDING METHOD

(71) Applicant: ZUIKO CORPORATION, Osaka (JP)

(72) Inventors: Hitoshi Sato, Osaka (JP); Yosuke Nishimura, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 115 days.

(21) Appl. No.: 16/344,206

(22) PCT Filed: Oct. 27, 2017

(86) PCT No.: PCT/JP2017/038878
§ 371 (c)(1),
(2) Date: Apr. 23, 2019

(87) PCT Pub. No.: WO2018/084078
PCT Pub. Date: May 11, 2018

(65) Prior Publication Data

US 2019/0256314 A1 Aug. 22, 2019

(30) Foreign Application Priority Data

Nov. 2, 2016 (JP) ..... JP2016-215658

(51) Int. Cl.
*B65H 19/18* (2006.01)
*B65H 20/16* (2006.01)
(Continued)

(52) U.S. Cl.
CPC ..... *B65H 19/18* (2013.01); *B65H 19/105* (2013.01); *B65H 19/1852* (2013.01);
(Continued)

(58) Field of Classification Search
CPC ..... B65H 19/105; B65H 19/1826; B65H 19/1852
See application file for complete search history.

(56) References Cited

U.S. PATENT DOCUMENTS 4,840,320 A 6/1989 Shigeta et al.
4,984,750 A 1/1991 Shigeta et al.
(Continued)

FOREIGN PATENT DOCUMENTS

CN 105692284 6/2016
DE 10 2014 222 166 5/2016
(Continued)

OTHER PUBLICATIONS

Google Patent Translation of JPH07101602A. (Year: 2021).*
(Continued)

*Primary Examiner* — Mark A Osele
(74) *Attorney, Agent, or Firm* — Wenderoth, Lind & Ponack, L.L.P.

(57) ABSTRACT

When a remaining amount of a sheet on one original sheet roll is equal to or less than a predetermined remaining amount, a pair of holding pads is brought into a first posture where holding surfaces are opened, and the holding surface of one holding pad is pressed to a joining end portion from the outside of the original sheet roll in a radial direction of another original sheet roll. Further, the holding pad is moved such that the joining end portion is separated toward the outside of the original sheet roll in the radial direction. Further, the posture of the pair of holding pads is changed into a second posture where the holding surfaces approach each other, and the joining end portion is conveyed to a joining part in a state where the joining end portion is sandwiched between the holding surfaces of the pair of holding pads.

9 Claims, 31 Drawing Sheets

(51) Int. Cl.

| | |
|---|---|
| ***B65H 20/12*** | (2006.01) |
| ***B65H 20/18*** | (2006.01) |
| ***B65H 26/06*** | (2006.01) |
| ***B65H 19/10*** | (2006.01) |

(52) U.S. Cl.

CPC ..... *B65H 19/1873* (2013.01); *B65H 20/12* (2013.01); *B65H 20/18* (2013.01); *B65H 26/063* (2013.01); *B65H 2301/4631* (2013.01); *B65H 2301/4633* (2013.01); *B65H 2301/46115* (2013.01); *B65H 2301/46412* (2013.01); *B65H 2406/334* (2013.01); *B65H 2406/3432* (2013.01); *B65H 2511/142* (2013.01); *B65H 2555/31* (2013.01); *B65H 2801/57* (2013.01)

(56) References Cited

U.S. PATENT DOCUMENTS

| | | | | |
|---|---|---|---|---|
| 5,381,983 | A * | 1/1995 | Sakano | B65H 19/105 242/562.1 |
| 2017/0137247 | A1 | 5/2017 | Sato et al. | |
| 2017/0137251 | A1 | 5/2017 | Sato et al. | |

FOREIGN PATENT DOCUMENTS

| | | |
|---|---|---|
| EP | 0 274 088 | 7/1988 |
| JP | 2-18246 | 1/1990 |
| JP | 2-18249 | 1/1990 |
| JP | 7-101602 | 4/1995 |
| WO | 2016/002531 | 1/2016 |
| WO | 2016/002532 | 1/2016 |

OTHER PUBLICATIONS

Extended European Search Report dated Sep. 16, 2019 in corresponding European Patent Application No. 17868469.2.

International Search Report dated Dec. 26, 2017 in International (PCT) Application No. PCT/JP2017/038878.

Office Action dated Mar. 3, 2020 in corresponding Chinese Patent Application No. 201780066150.4 with English-language translation.

* cited by examiner

SHEET-FEEDING SYSTEM AND SHEET-FEEDING METHOD

TECHNICAL FIELD

The present invention relates to a system and a method for continuously feeding a sheet.

BACKGROUND ART

Conventionally, in applying various kinds of workings to a sheet, there has been known a case where the sheet is continuously fed from a roll around which the sheet is wound, and the sheet is supplied to a working apparatus or the like. For example, a disposable diaper is formed of a plurality of sheets having different materials and widths such as a nonwoven fabric, a film and a tissue. In the manufacture of such a diaper, various kinds of sheets are continuously fed from plural kinds of rolls which are respectively formed of the various kinds of sheets, and various kinds of workings are applied to the various kinds of sheets.

With respect to such a system which continuously feeds sheets, for enhancing an operation efficiency of a sheet-feeding operation, studies have been made so as to supply the sheet to a working apparatus or the like without causing interruption of feeding of the sheet.

Under such circumstances, for example, WO 2016/002531 discloses a system which includes: a roll holding part which rotatably holds a plurality of rolls; and a joining part which can join sheets to each other. In this system, when a remaining amount of a sheet of the roll which is held by the roll holding part and from which the sheet is fed becomes small, an end portion of a sheet of an unused standby side roll which is another roll held by the roll holding part is taken out and is conveyed to the joining part, the end portion is joined to a middle portion of the sheet under a feeding operation at the joining part and, then, the sheet is fed from the standby side roll.

Specifically, the system described in WO 2016/002531 is configured such that a suction roller is used for taking out the end portion of the sheet from the standby side roll, and the end portion of the sheet taken out from the standby side roll is conveyed to the joining part by an additionally provided conveyance apparatus. The suction roller is a roller having an outer peripheral surface capable of sucking the sheet and capable of coming into contact with an outer peripheral surface of a standby side original sheet roll in a rolling manner. By rotating the suction roller and the standby side original sheet roller in opposite directions while bringing these rollers into contact with each other, the end portion of the sheet of the standby side original sheet roll is sucked and held by the outer peripheral surface of the suction roller, and is peeled off from the outer peripheral surface of the standby side original sheet roll.

In the system described in WO 2016/002531, to peel off the end portion of the sheet from the standby side original sheet roll by making the outer peripheral surface of the suction roller suck the end portion of the sheet, it is necessary to insert the end portion of the sheet into a gap between the outer peripheral surface of the suction roller and the outer peripheral surface of the standby side original sheet roll. However, as described previously, the suction roller and the standby side original sheet roll are rotated in a state where the suction roller and the standby side original sheet roll are in contact with each other. Accordingly, the end portion of the sheet cannot smoothly enter the gap between the suction roller and the standby side original sheet roll and hence, the sheet becomes jammed in the gap thus giving rise to a case where the suction roller cannot properly suck and hold the end portion of the sheet.

As described above, the system described in WO 2016/002531 has a drawback that the end portion of the sheet cannot be properly conveyed to the joining part so that an operation efficiency cannot be sufficiently increased.

SUMMARY OF INVENTION

It is an object of the present invention to provide a sheet-feeding system and a sheet-feeding method which can increase an operation efficiency with more certainty.

To achieve the above-mentioned object, the present invention provides a sheet-feeding system for continuously feeding a sheet, the sheet-feeding system including: a roll holding part configured such that a pair of original sheet rolls around which sheets are respectively wound is held in a rotatable state thus enabling feeding of the sheets; a joining part configured such that, with respect to the pair of original sheet rolls, to a middle portion of the sheet of one original sheet roll from which the sheet is fed, a joining end portion which is an end portion of the sheet of the other original sheet roll from which the sheet is not fed is joined; a remaining sheet amount detection unit for detecting a remaining amount of the sheet of the one original sheet roll; an end portion holding device having: a holding unit capable of holding the joining end portion; and a moving mechanism capable of moving the holding unit between the other original sheet roll and the joining part; and a controller for controlling the end portion holding device, in which the holding unit has: a pair of holding pads having a holding surface respectively; a support part for supporting the pair of holding pads; a suction mechanism capable of making the holding surface of at least one holding pad out of the pair of holding pads suck the joining end portion; and a sandwiching mechanism capable of changing a posture of the pair of holding pads with respect to the support part between a first posture where the holding surfaces of the pair of holding pads are opened so as to enable pressing of the holding surface of the one holding pad to the joining end portion from an outside of the other original sheet roll in a radial direction of the other original sheet roll and a second posture where the holding surfaces of the pair of holding pads are made closer to each other so as to enable sandwiching of the joining end portion by the holding surfaces of the pair of holding pads, the controller is configured to control, in a case where a sheet joining condition where a remaining amount of the sheet of the one original sheet roll is equal to or less than a predetermined remaining amount which is set in advance is established, the moving mechanism, the suction mechanism, and the sandwiching mechanism so as to move the holding unit such that, in a state where the pair of holding pads is in the first posture, the holding surface of the one holding pad is pressed to the joining end portion from the outside of the other original sheet roll in the radial direction, to move the holding unit while holding the joining end portion to the holding surface of the one holding pad by suction such that the joining end portion is separated toward the outside of the other original sheet roll in the radial direction, and to move the holding unit such that the joining end portion is conveyed to the joining part in a state where the joining end portion is sandwiched by the holding surfaces of the pair of holding pads by changing the posture of the pair of holding pads from the first posture to the second posture.

Further, the present invention provides a sheet-feeding method for continuously feeding a sheet using a sheet-feeding system, in which the sheet-feeding system includes: a roll holding part configured such that a pair of original sheet rolls around which sheets are respectively wound is held in a rotatable state thus enabling feeding of the sheets; a joining part configured such that, with respect to the pair of original sheet rolls, to a middle portion of the sheet of one original sheet roll from which the sheet is fed, a joining end portion which is an end portion of the sheet of the other original sheet roll from which the sheet is not fed is joined; and an end portion holding device having: a holding unit capable of holding the joining end portion; and a moving mechanism capable of moving the holding unit between the other original sheet roll and the joining part, and the holding unit has: a pair of holding pads having a holding surface respectively; a support part for supporting the pair of holding pads; a suction mechanism capable of making the holding surface of at least one holding pad out of the pair of holding pads suck the joining end portion; and a sandwiching mechanism capable of changing a posture of the pair of holding pads with respect to the support part between a first posture where the holding surfaces of the pair of holding pads are opened so as to enable pressing of the holding surface of the one holding pad to the joining end portion from an outside of the other original sheet roll in a radial direction of the other original sheet roll and a second posture where the holding surfaces of the pair of holding pads are made closer to each other so as to enable sandwiching of the joining end portion by the holding surfaces of the pair of holding pads, and the sheet-feeding method includes steps of: in a case where a sheet joining condition where a remaining amount of the sheet of the one original sheet roll is equal to or less than a predetermined remaining amount is established, moving the holding unit such that, in a state where the pair of holding pads is in the first posture, the holding surface of the one holding pad is pressed to the joining end portion from the outside of the other original sheet roll in the radial direction; moving the holding unit while holding the joining end portion to the holding surface of the one holding pad by suction such that the joining end portion is separated toward the outside of the other original sheet roll in the radial direction; and moving the holding unit such that the joining end portion is conveyed to the joining part in a state where the joining end portion is sandwiched by the holding surfaces of the pair of holding pads by changing the posture of the pair of holding pads from the first posture to the second posture.

According to the present invention, it is possible to enhance operation efficiency with more certainty.

DESCRIPTION OF EMBODIMENTS

Hereinafter, embodiments of the present invention are described with reference to attached drawings. The embodiments described hereinafter are merely illustrative and are not intended to limit the technical scope of the present invention.

Figure 1:
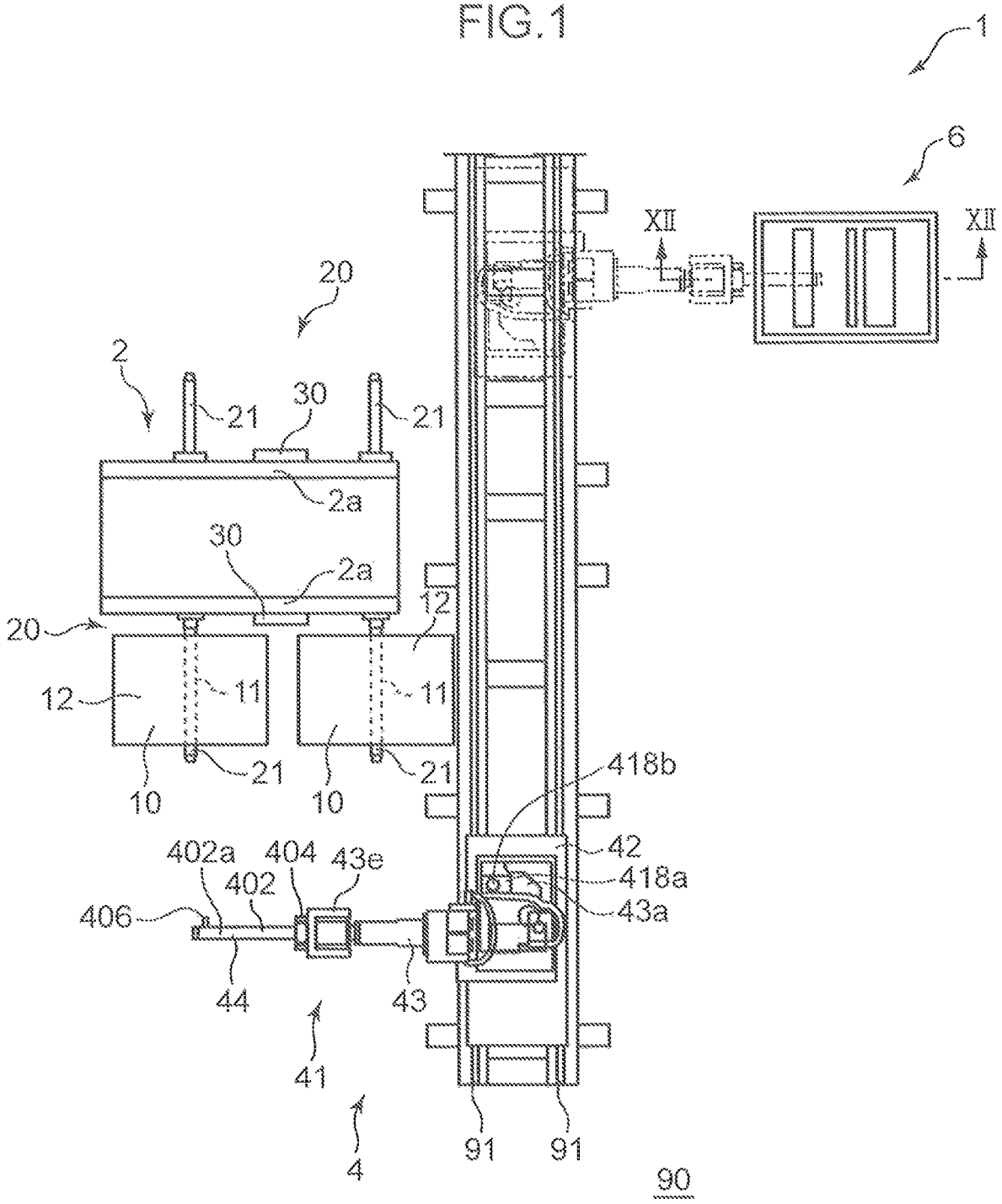
FIG. 1 is a plan view schematically showing an overall configuration of a sheet-feeding system according to an embodiment of the present invention.
Figure 2:
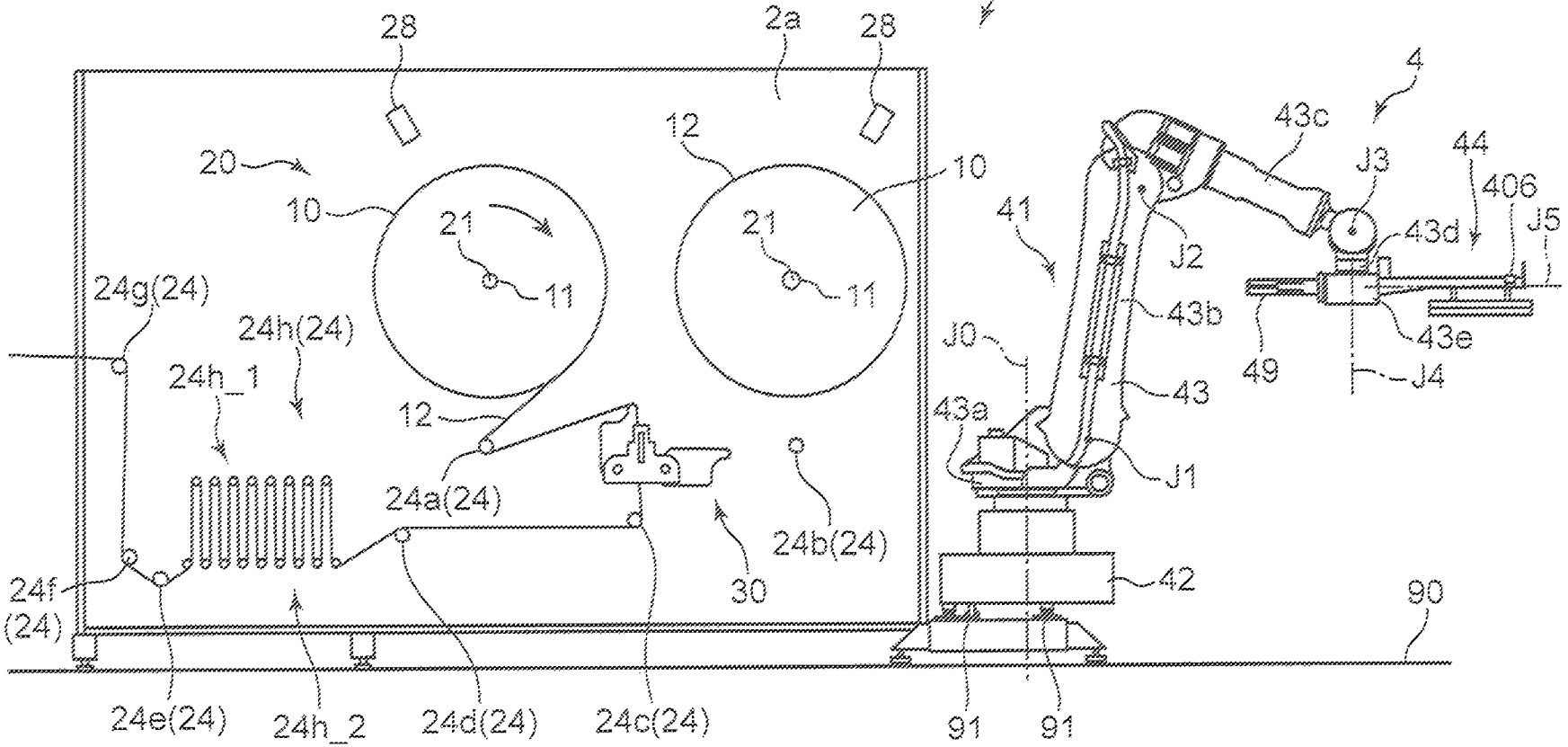
FIG. 2 is a side view schematically showing the overall configuration of the sheet-feeding system.

FIG. 1 and FIG. 2 are a plan view and a side view schematically showing the overall configuration of a sheet-feeding system 1 according to an embodiment of the present invention.

The sheet-feeding system 1 is a system for continuously feeding a sheet 12 from an original sheet roll 10 around which the sheet 12 is wound. The sheet-feeding system 1 includes: a sheet-feeding device 2; an operation robot (an end portion holding device, a sheet conveyance unit, a nozzle moving unit) 4; a cleaning unit 6; and a controller 100 (control part, see FIG. 13). In this embodiment, the original sheet roll 10 has a circular cylindrical core member 11, and the sheet 12 which is wound around the core member 11. The sheet-feeding system 1 is used in a manufacturing system for manufacturing a disposable diaper, for example. In the manufacturing system, various kinds of workings are applied to the sheet 12 supplied from the sheet-feeding system 1 thus manufacturing a disposable diaper.

(1) Sheet-Feeding Device

The sheet-feeding device 2 has two support walls 2*a*, 2*a*, roll holding parts 20 each of which is supported on the support wall 2*a*, a guide part 24, a joining part 30, and remaining sheet amount detectors (remaining sheet amount detection units) 28.

Hereinafter, in the description of the sheet-feeding device 2 made hereinafter, unless otherwise directions are particularly specified, a direction along a pair of rails 91 on which the operation robot 4 moves, that is, a vertical direction in FIG. 1 is referred to as a longitudinal direction, and a left-and-right direction in FIG. 1 is simply referred to as a lateral direction.

The respective support walls 2*a* respectively extend upward from a mounting surface 90 and, at the same time, extend lateral direction, and are arranged parallel to each other along the longitudinal direction. On the front support wall 2*a* and the rear support wall 2*a*, respective parts 20, 24, 30, 28 are respectively supported. Hereinafter, as a representative, the rear support wall 2*a* and the respective parts 20, 24, 30, 28 supported on the rear support wall 2*a* are described.

(Roll Holding Part)

The roll holding part 20 holds a pair of original sheet rolls (a first original sheet roll and a second original sheet roll) 10, 10 in a rotatable state where the sheet 12 is fed from the respective original sheet rolls 10, 10.

Figure 13:
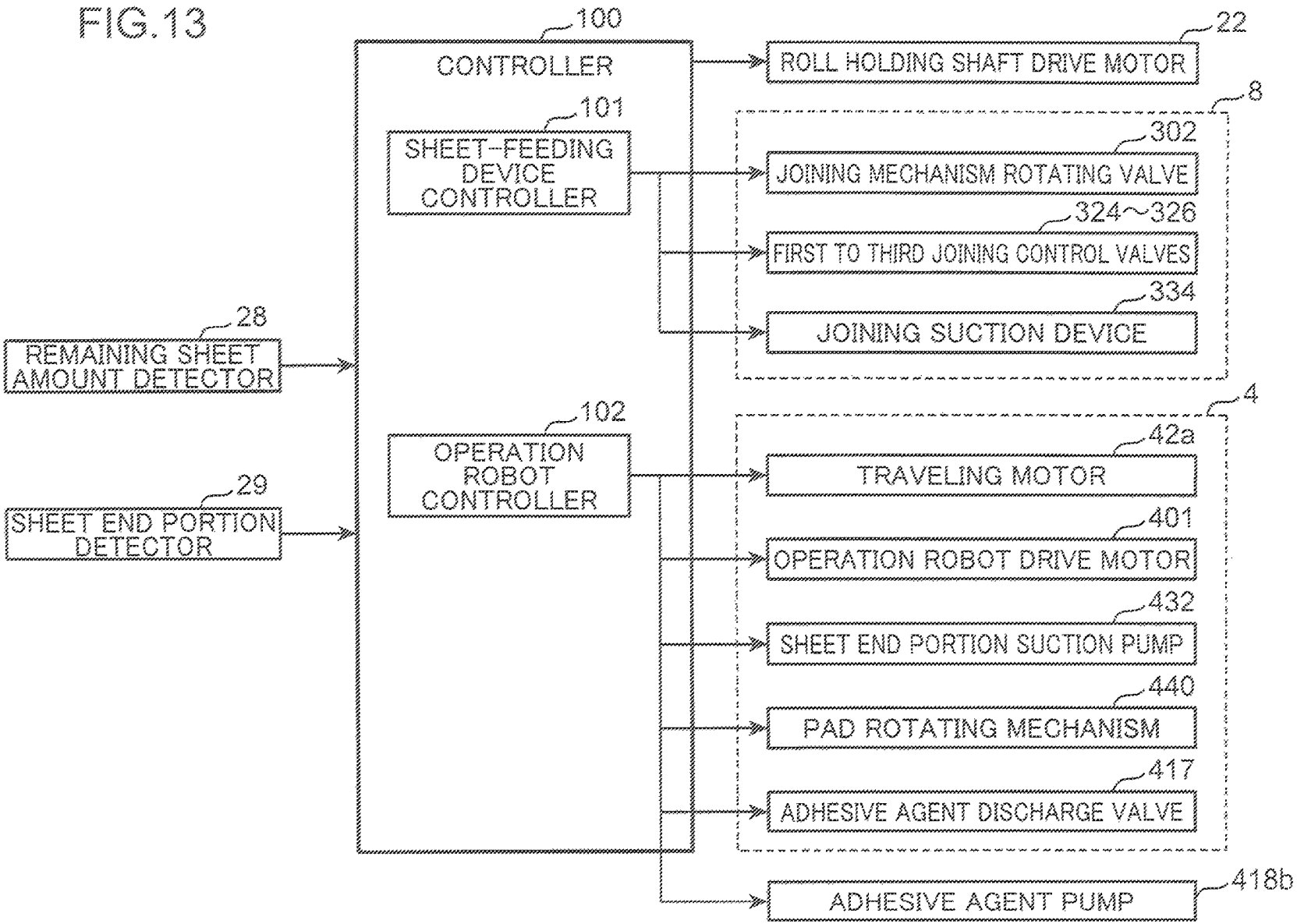
FIG. 13 is a block diagram showing inputting and outputting of a controller.
Figure 14:
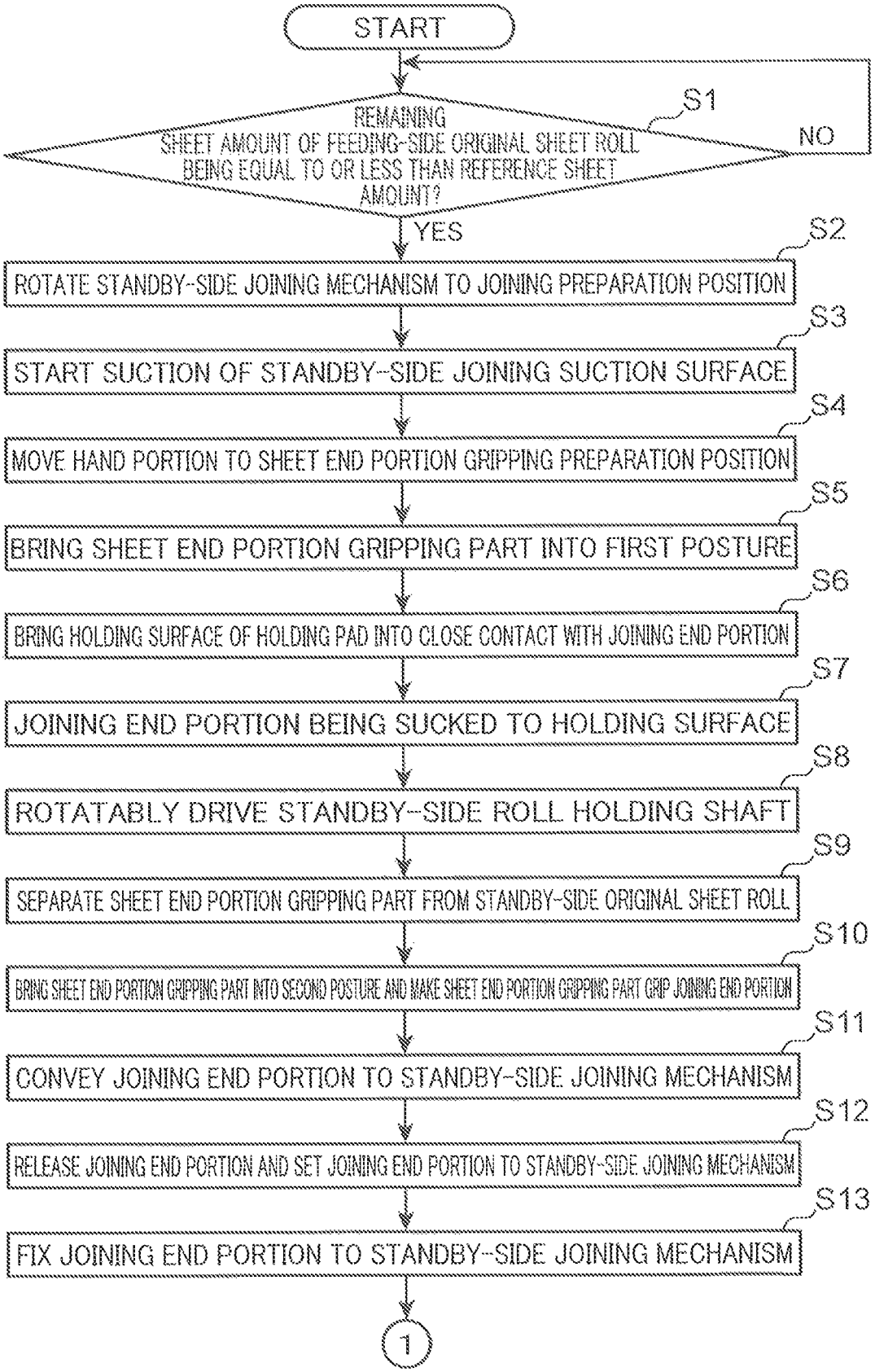
FIG. 14 is a former half of a flowchart showing joining steps.
Figure 15:
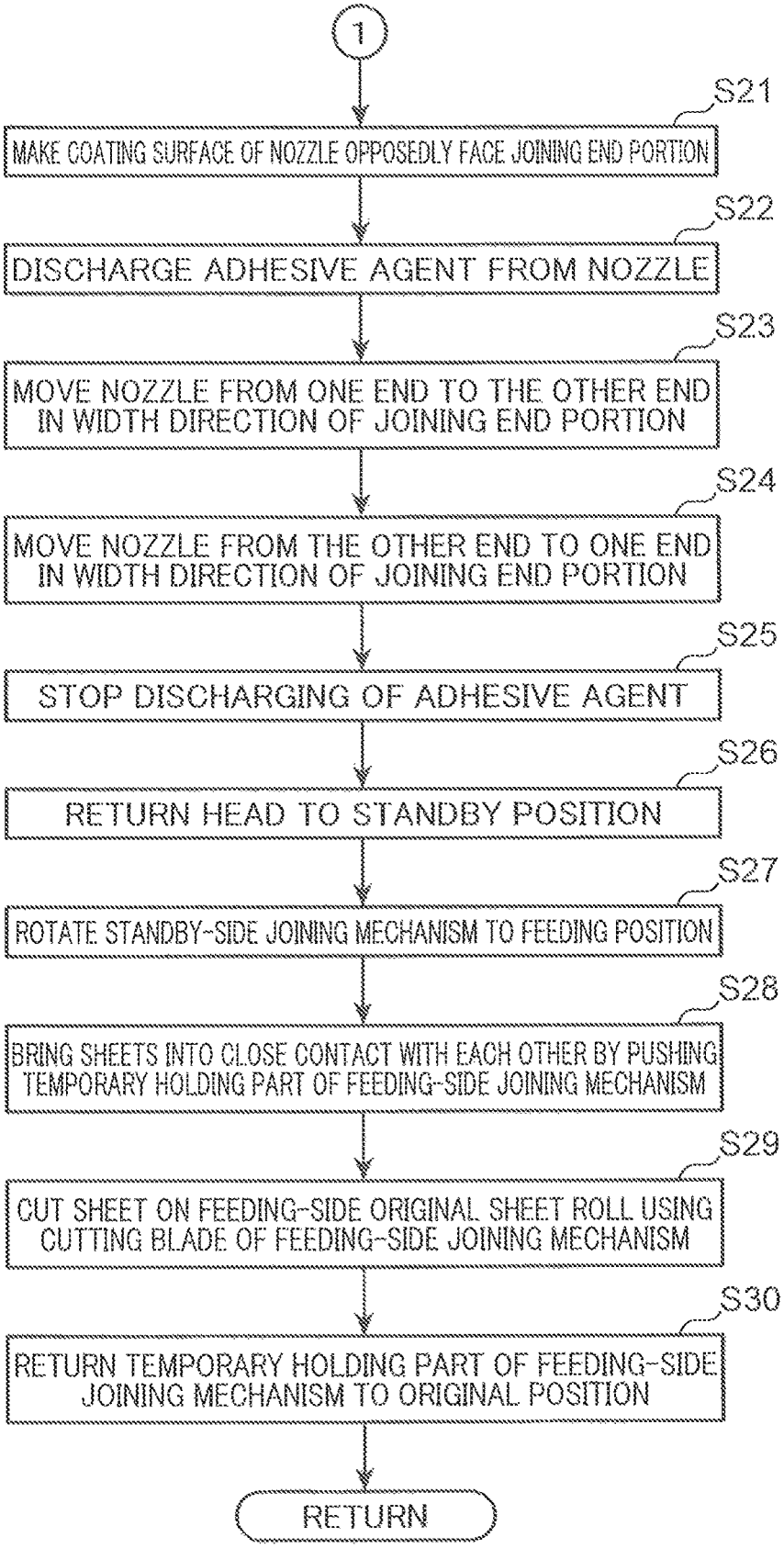
FIG. 15 is a latter half of the flowchart showing the joining steps.

The roll holding part 20 has a pair of roll holding shafts 21, 21, and a pair of roll holding shaft drive motors (drive parts) 22, 22 (see FIG. 13).

Each of the respective roll holding shafts 21 has an approximately circular columnar shape extending in the longitudinal direction, and is inserted into the inside of a core member 11 of the original sheet roll 10 thus supporting the original sheet roll 10. The respective roll holding shafts 21 extend rearward from the support wall 2*a*. These roll holding shafts 21 are arranged side by side to each other in the lateral direction at the same height. Each of the respective roll holding shafts 21 is rotatably supported on the support wall 2*a* about a center axis of the roll holding shaft 21.

Each roll holding shaft drive motor 22 is a motor for rotatably driving each roll holding shaft 21 about a center axis of the roll holding shaft 21. When the roll holding shaft 21 is rotatably driven by the roll holding shaft drive motor 22, along with the rotation of the roll holding shaft 21, the original sheet roll 10 is also rotated so that the sheet 12 is fed from the original sheet roll 10.

In this embodiment, the pair of original sheet rolls 10 is held by the roll holding shafts 21 respectively such that the sheets 12 are fed by the rotation of the original sheet rolls 10 in opposite directions. Specifically, the original sheet roll 10 is held on the right roll holding shaft 21 such that the sheet 12 is fed by rotating the original sheet roll 10 in a counter-clockwise direction as viewed from a rear side, and the original sheet roll 10 is held on the left roll holding shaft 21 such that the sheet 12 is fed by rotating the original sheet roll 10 in a clockwise direction as viewed from a rear side.

(Guide Part)

The guide part 24 is provided for guiding the sheet 12 along a preset path. The guide part 24 includes: a plurality of guide rollers 24*a* to 24*g* for supporting the sheets 12 fed from the respective original sheet rolls 10 held by the respective roll holding shafts 21 along a predetermined path; and a sheet retaining mechanism 24*h* which can temporarily reserve a predetermined amount of the sheet 12 fed from the original sheet roll 10.

Among the guide rollers 24*a* to 24*g*, the guide rollers 24*c* to 24*g* are used in common by the sheets 12 of both the original sheet rolls 10. On the other hand, the guide roller 24*a* is used for guiding the original sheet roll 10 held on the left roll holding shaft 21 to the joining part 30, the guide roller 24*b* is used for guiding the original sheet roll 10 held on the right roll holding shaft 21 to the joining part 30.

The sheet retaining mechanism 24*h* has: an upper roller group 24*h*_1 which is formed of a plurality of rollers; a lower roller group 24*h*_2 which is formed of a plurality of rollers; and a mechanism (not shown in the drawing) which is capable of moving the roller groups 24*h*_1, 24*h*_2 in a direction that the roller groups 24*h*_1, 24*h*_2 approach each other or in a direction that the roller groups 24*h*_1, 24*h*_2 are separated from each other. By extending the sheet 12 between the roller groups 24*h*_1, 24*h*_2 in a state where the roller groups 24*h*_1, 24*h*_2 are spaced apart from each other, and by making the roller groups 24*h*_1, 24*h*_2 approach each other from such a state, the sheet 12 can be fed toward a downstream side of the roller groups 24*h*_1, 24*h*_2 in a state where the rotation of the original sheet roll 10 is stopped.

(Remaining Sheet Amount Detector)

The remaining sheet amount detector 28 is provided for detecting a remaining amount of the sheet 12 of the original sheet roll 10 held on the roll holding shaft 21. In this embodiment, the remaining sheet amount detector 28 is provided to each of two roll holding shafts 21 individually.

Each remaining sheet amount detector 28 is mounted on the support wall 2*a* at a position away from the original sheet roll 10 held on the roll holding shaft 21 corresponding to the remaining sheet amount detector 28, and detects a distance from the remaining sheet amount detector 28 to an outer peripheral surface of the original sheet roll 10. A detection result obtained by the remaining sheet amount detector 28 is transmitted to the controller 100. The controller 100 calculates a radius of the original sheet roll 10, that is, a remaining amount of the sheet 12 based on the detection result and the distance, which is preliminarily stored in the controller 100, from the remaining sheet amount detector 28 to the roll holding shaft 21.

(Joining Part)

The joining part 30 is provided for performing a joining operation where, with respect to two original sheet rolls 10 respectively held on two roll holding shafts 21, an end portion 13 of the sheet 12 on the original sheet roll 10 from which the sheet 12 is not fed is joined to a middle portion of the original sheet roll 10 from which the sheet 12 is fed. In FIG. 2, the sheet 12 is fed from the left original sheet roll 10, and the end portion of the sheet 12 of the right original sheet roll 10 is scheduled to be joined to the sheet 12 of the left original sheet roll 10.

Figure 3:
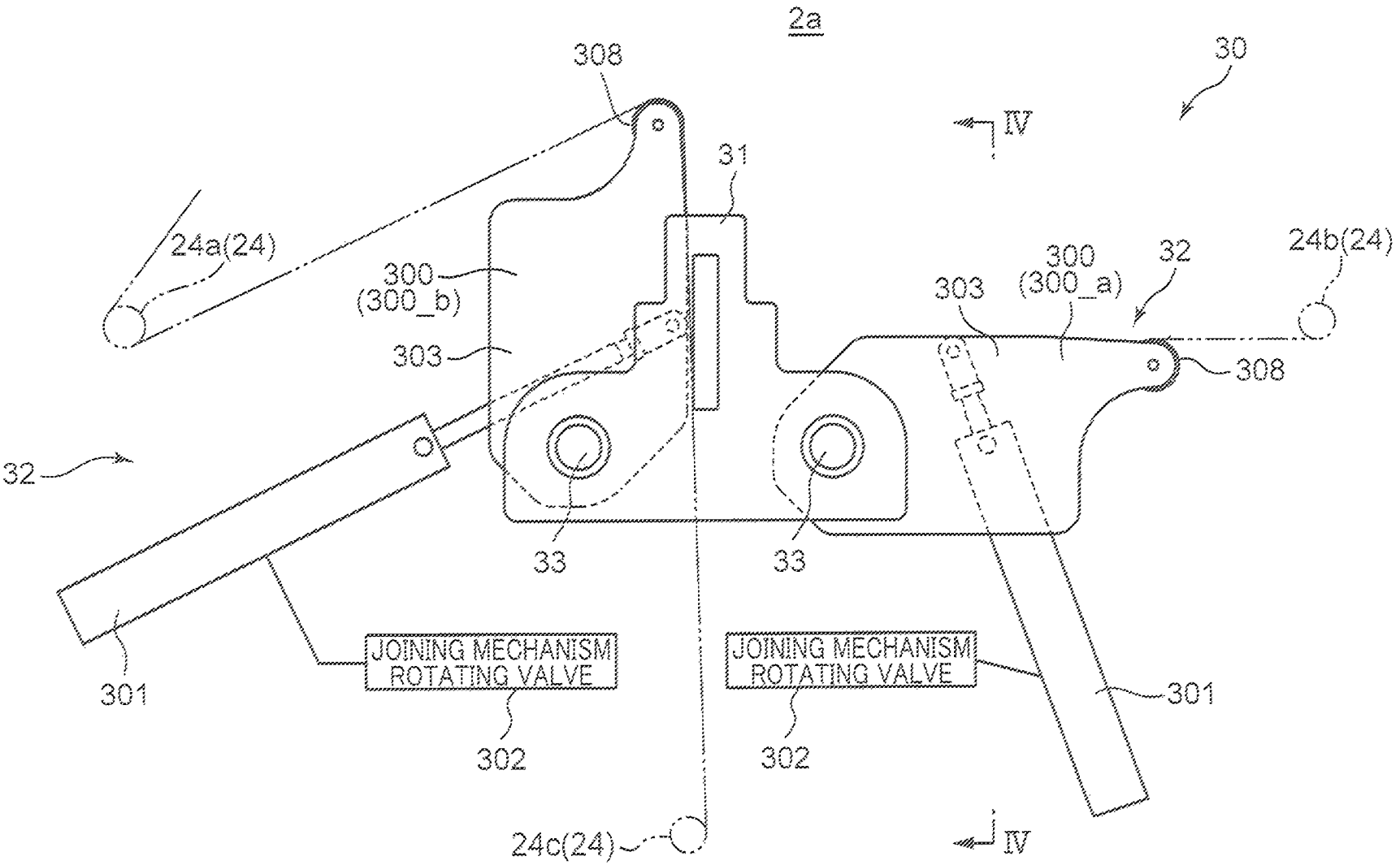
FIG. 3 is a view showing a joining part and a periphery of the joining part shown in FIG. 2 in an enlarged manner.
Figure 4:
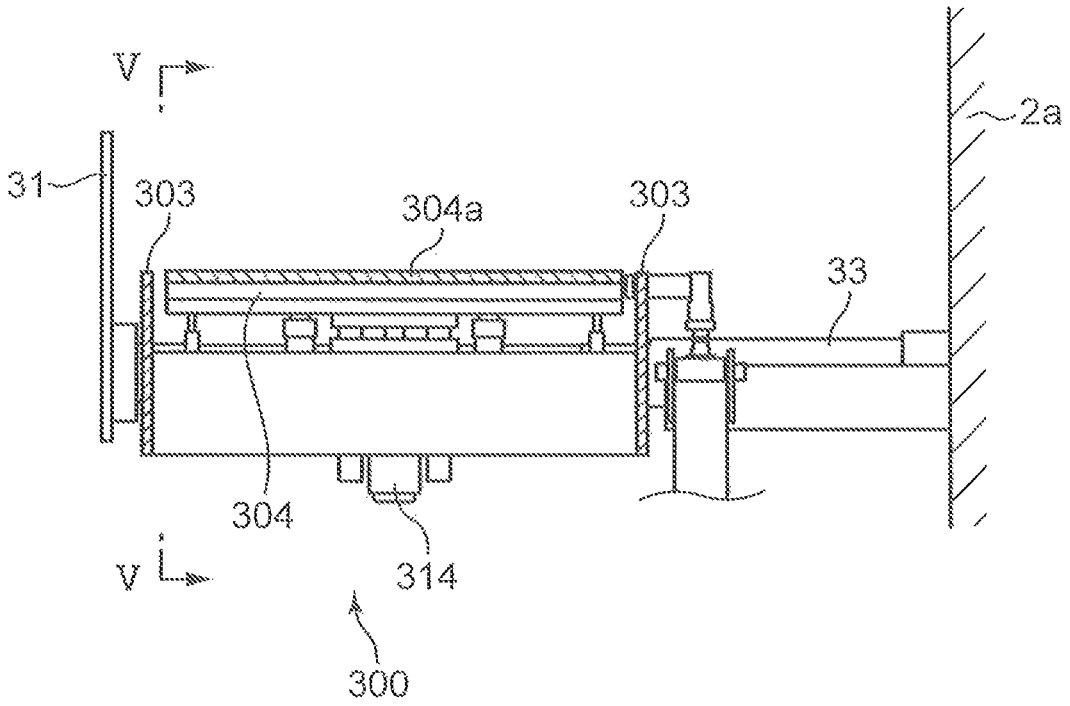
FIG. 4 is a cross-sectional view taken along a line IV-IV in FIG. 3.
Figure 5:
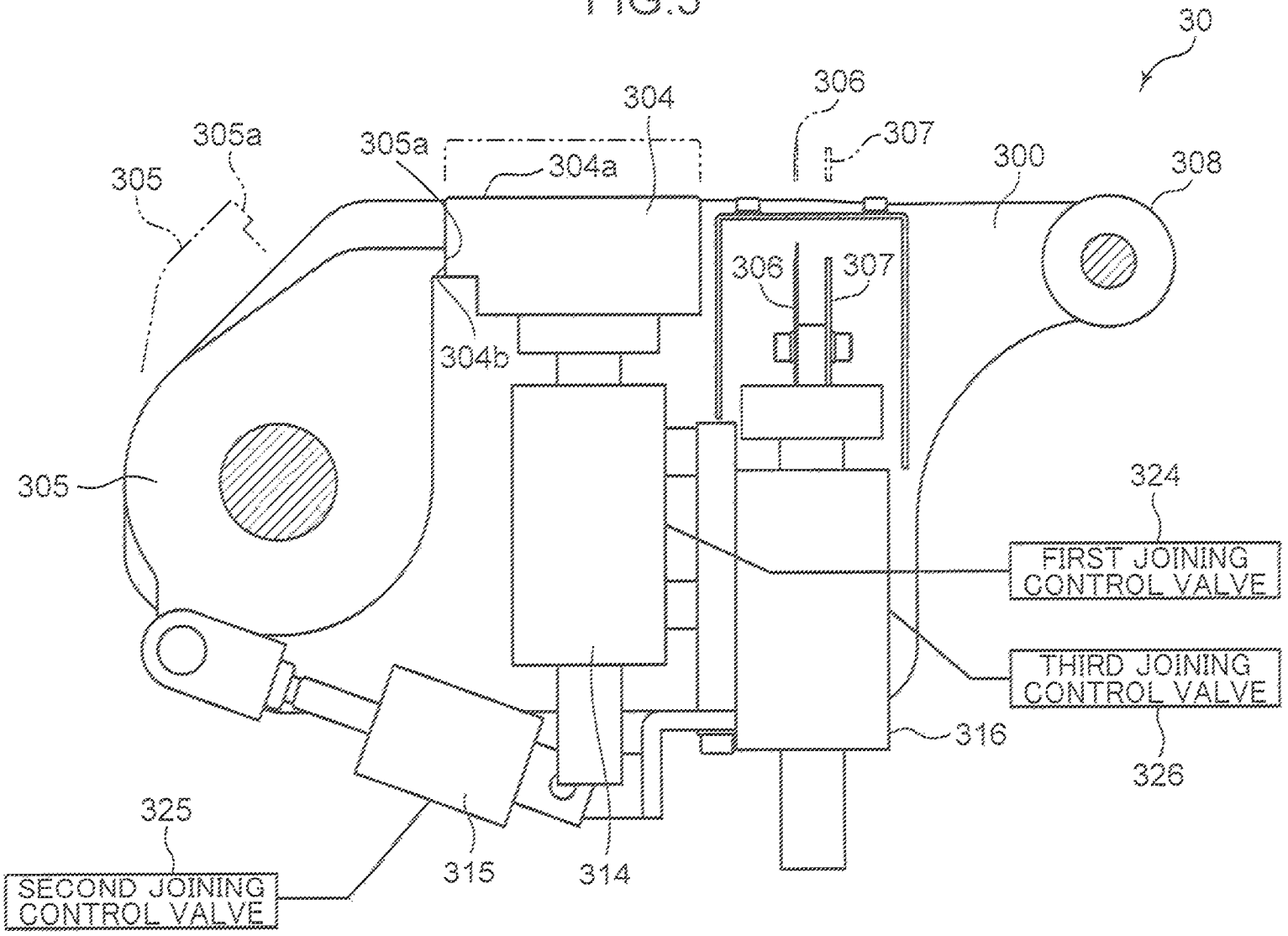
FIG. 5 is a cross-sectional view taken along a line V-V in FIG. 4.

FIG. 3 is a front view of the joining part 30 and a surrounding of the joining part 30 shown in FIG. 2 in an enlarged manner. FIG. 4 is a schematically cross-sectional view taken along a line IV-IV in FIG. 3. FIG. 5 is a schematically cross-sectional view taken along a line V-V in FIG. 4.

The joining part 30 has: one shaft support plate 31 which opposedly faces the support walls 2*a*, and a pair of left and right joining devices 32, 32 which is arranged between the support walls 2*a* and the shaft support plate 31 respectively. Two joining devices 32 have the configurations laterally symmetrical to each other. In the description made hereinafter, as the representative of these two joining devices 32, the joining device 32 on a right side in FIG. 3 is described.

The joining device 32 has: a shaft 33 extending in the longitudinal direction between the support wall 2*a* and the shaft support plate 31; a joining mechanism 300 which is mounted on the support wall 2*a* in a rotatable state about the shaft 33; a joining mechanism rotating cylinder 301 which rotatably drives the joining mechanism 300; and a joining mechanism rotating valve 302 which controls driving of the joining mechanism rotating cylinder 301.

The joining mechanism 300 is rotatably driven by the joining mechanism rotating cylinder 301 between a joining preparation position where the sheet 12 is guided in an approximately horizontal direction by a joining holding roller 308 described later and the guide roller 24 positioned upstream of the guide roller 24*c* in a conveyance direction of the sheet 12 and a feeding position where the sheet 12 is guided in the vertical direction by the joining holding roller 308 and the guide roller 24 positioned upstream of the guide roller 24*c* in the conveyance direction of the sheet 12.

For example, in FIG. 3, the right joining mechanism 300_*a* is arranged at the joining preparation position where the sheet 12 is guided in the approximately horizontal direction by the joining holding roller 308 and the guide roller 24*b* positioned upstream of the guide roller 24*c* in the conveyance direction of the sheet 12, and the left joining mechanism 300_*b* is arranged at the feeding position where the sheet 12 is guided in the vertical direction by the joining holding roller 308 and the guide roller 24*a* positioned upstream of the guide roller 24*c* in the conveyance direction of the sheet 12.

The joining mechanism 300 has: a pair of opposedly facing plates 303, 303 which extends in a direction away from the shafts 33 respectively and opposedly faces each other in the longitudinal direction; and the joining holding roller 308 which is supported on the opposedly facing plates 303. The joining mechanism 300 also has temporary holding parts (a first temporary holding part, a second temporary holding part) 304, a sheet end portion pressing member 305, and a cutting blade 306 which are respectively arranged between the opposedly facing plates 303, 303. The joining mechanism 300 also includes: a first joining cylinder 314 for driving the temporary holding part 304 and a first joining control valve 324 for controlling driving of the first joining cylinder 314; a second joining cylinder 315 for driving the sheet end portion pressing member 305 and a second joining control valve 325 for controlling driving of the second joining cylinder 315; and a third joining cylinder 316 for driving the cutting blade 306 and a third joining control valve 326 for controlling driving of the third joining cylinder 316. The joining mechanism 300 also has a pressing blade 307 which moves integrally with the cutting blade 306.

The joining holding roller 308 is a member for guiding the sheet 12 toward the guide roller 24*c* from the guide roller 24*b* positioned upstream of the guide roller 24*c* in the conveyance direction of the sheet 12. The joining holding roller 308 has an approximately circular columnar shape extending in the longitudinal direction, and is supported on an end portion of the opposedly facing plate 303 on a side opposite to the shaft 33 in the longitudinal direction of the opposedly facing plate 303. The joining holding roller 308 is supported on the respective opposedly facing plates 303 in a rotatable state about a center axis thereof.

The temporary holding part 304 has a surface (hereinafter, referred to as a joining suction surface) 304*a* which is capable of holding the end portion 13 of the sheet 12 of the original sheet roll 10 from which the sheet 12 is not fed (hereinafter referred to as a joining end portion 13 when necessary). Specifically, a plurality of holes are formed in the joining suction surface 304*a*. Air in the holes is sucked by a joining suction device 334 (see FIG. 13) so that the sheet 12 is sucked to the joining suction surface 304*a*. The joining suction surface 304*a* is an approximately flat surface, and the joining suction surface 304*a* takes an approximately horizontally extending posture in a state where the joining mechanism 300 is at the joining preparation position.

The first joining cylinder 314 drives the temporary holding part 304 in an extensible and shrinkable manner in a direction orthogonal to the joining suction surface 304*a*.

The sheet end portion pressing member 305 has a sheet end portion pressing surface 305*a* for sandwiching the joining end portion 13 between the sheet end portion pressing member 305 and a surface to be pressed 304*b* of the temporary holding part 304. The surface to be pressed 304*b* of the temporary holding part 304 is one side surface of the temporary holding part 304 and is a surface which extends from an edge portion of the joining suction surface 304*a* in a direction opposite to a direction that the joining suction surface 304*a* faces and faces a sheet end portion pressing member 305 side. The sheet end portion pressing member 305 rotates in a direction that the sheet end portion pressing surface 305*a* approaches the surface to be pressed 304*b* as indicated by a solid line or in a direction that the sheet end portion pressing surface 305*a* is separated from the surface to be pressed 304*b* as indicated by a chain line in FIG. 5 in response to an extending or shrinking operation of the second joining cylinder 315. With such operations, the joining end portion 13 is sandwiched between the sheet end portion pressing surface 305*a* and the surface to be pressed 304*b* or the joining end portion 13 is released.

The cutting blade 306 and the pressing blade 307 are provided for cutting the sheet 12 arranged at the position which opposedly faces the cutting blade 306 and the pressing blade 307. These blades 306, 307 advance or retract in a direction parallel to a direction orthogonal to the joining suction surface 304*a* as indicated by a solid line and a chain line in FIG. 5 in response to an extending or shrinking operation of the third joining cylinder 316 thus cutting the sheet 12 due to such an advancing and retracting operation.

(2) Operation Robot

As shown in FIG. 1 and FIG. 2, the operation robot 4 includes: a traveling part 42 which slidably moves on the rails 91; and an arm 43 which is connected to the traveling part 42.

A traveling motor 42*a* (see FIG. 13) is incorporated in the traveling part 42. The traveling part 42, that is, the operation robot 4 moves on the rails 91 by being driven by the traveling motor 42*a*.

The arm 43 has: a proximal end portion 43*a* connected to the traveling part 42; and a head 43*e* which is displaceable relative to the proximal end portion 43*a*.

Specifically, as shown in FIG. 2, the proximal end portion 43*a* is connected to the traveling part 42 in a state where the proximal end portion 43*a* is turnable about a turning axis J0 extending in the vertical direction. The arm 43 includes: a first arm 43*b* which is swingably connected to the proximal end portion 43*a* about a first axis J1 extending in the horizontal direction; a second arm 43*c* which is swingably connected to the first arm 43*b* about a second axis J2 extending in the horizontal direction; and a third arm 43*d* which is swingably connected to the second arm 43*c* about a third axis J3 extending in the horizontal direction. The head 43*e* is turnably connected to the third arm 43*d* about a fourth axis J4 extending in a direction orthogonal to the third axis J3.

A hand 44 is rotatably connected to one side surface of the head 43*e* about a fifth axis (rotation center axis) J5 extending in a direction orthogonal to the fourth axis J4.

The proximal end portion 43*a*, the respective arms 43*b*, 43*c*, 43*d*, the head 43*e* and the hand 44 are driven by a plurality of motors mounted on the operation robot 4 respectively so that these parts are turned (rotated) or swung about the respective axes J0 to J5. Hereinafter, the motors for driving the proximal end portion 43*a*, the respective arms 43*b*, 43*c*, 43*d*, the head 43*e* and the hand 44 are collectively referred to as operation robot drive motors 401 (see FIG. 13).

Figure 6:
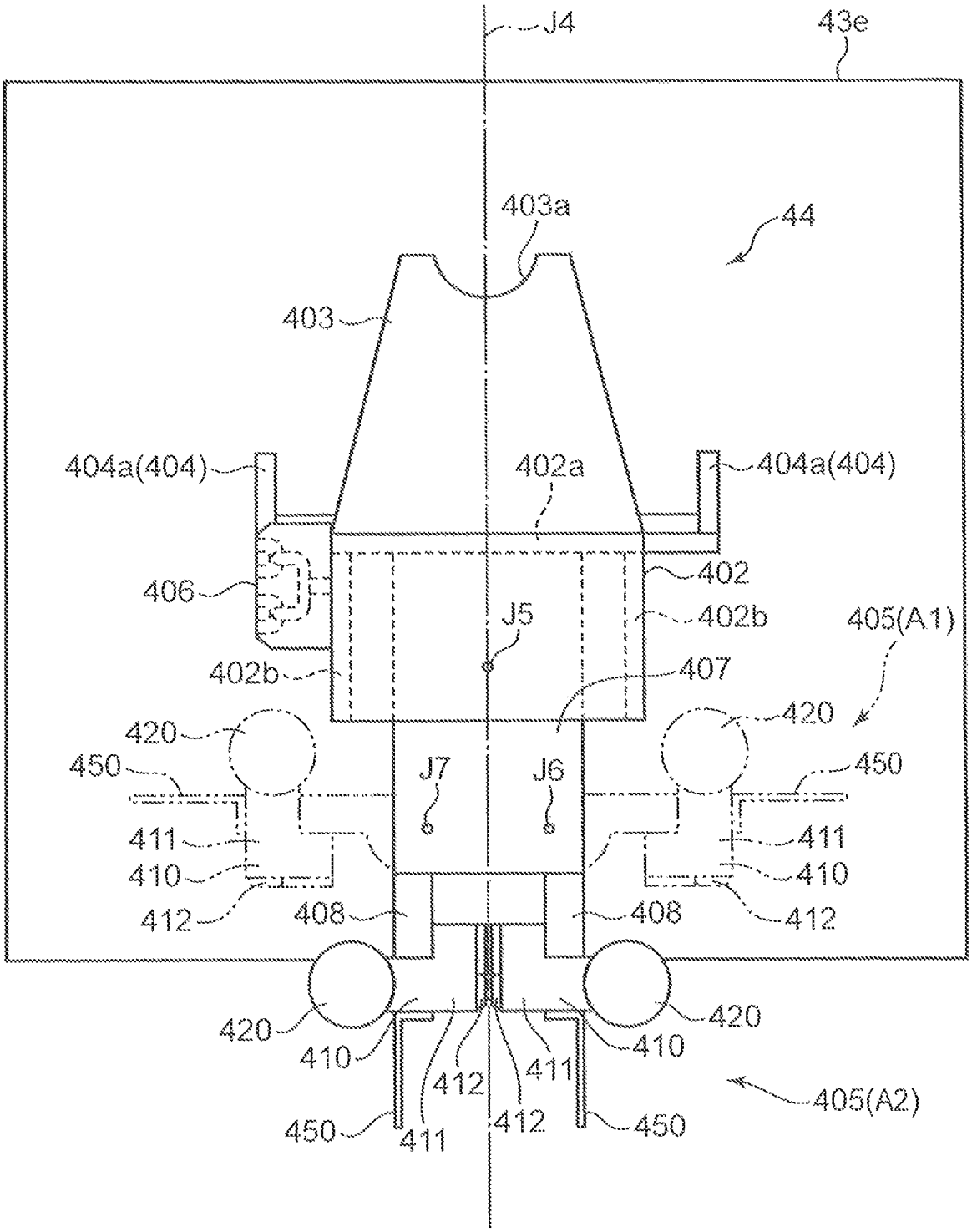
FIG. 6 is a schematic front view of a head.
Figure 7:
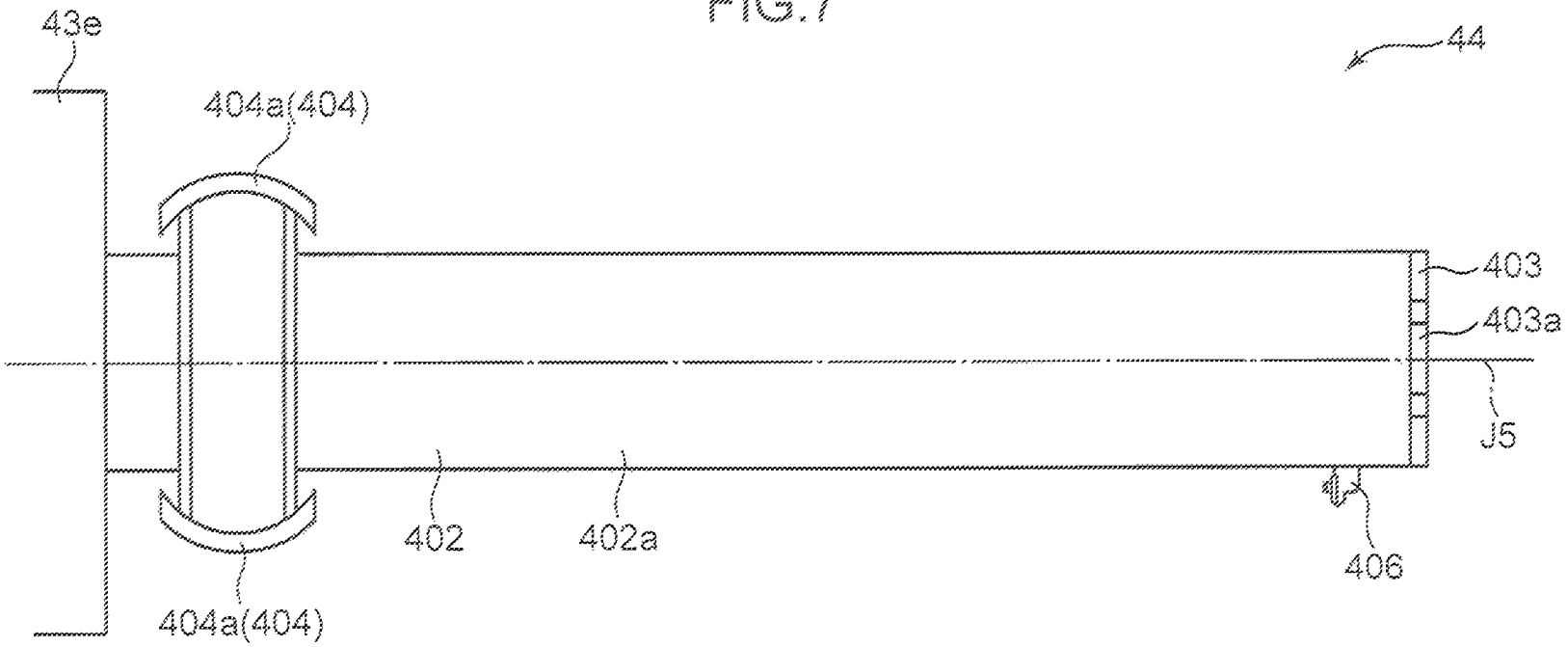
FIG. 7 is a schematic view of a hand as viewed from an upper side in FIG. 6.
Figure 8:
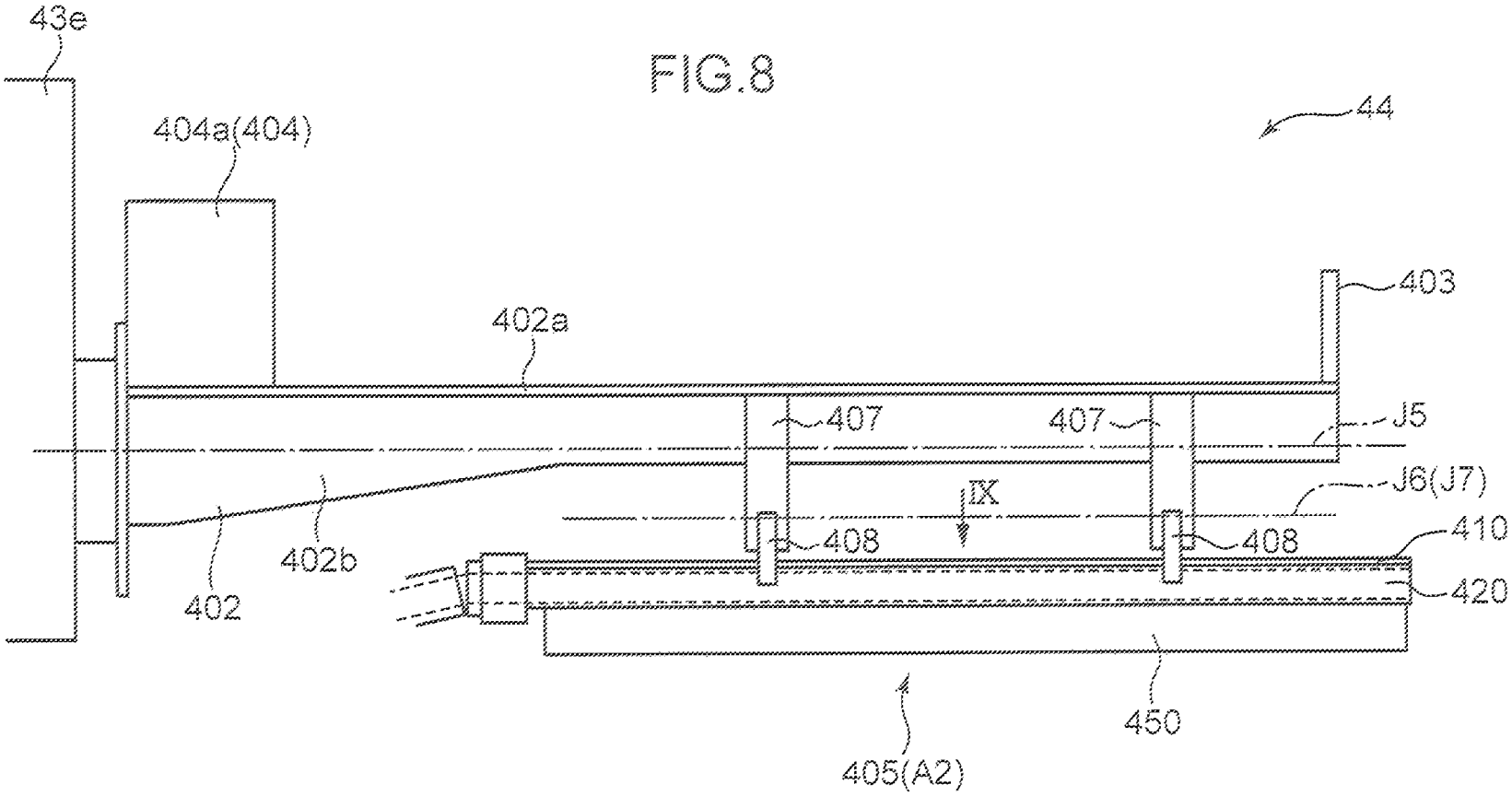
FIG. 8 is a schematic view of the hand as viewed from a left side in FIG. 6.

FIG. 6 is a schematic front view of the hand 44. FIG. 7 is a schematic plan view of the hand 44 as viewed from an upper side in FIG. 6. FIG. 8 is a schematic side view of the hand 44 in a state where one upright wall 402*b* of a base part 402 described later is removed.

The hand 44 has the base part 402 extending from one side surface of the head 43*e* in a direction parallel to the fifth axis J5. The hand 44 also has: a pawl part 403; a used roll gripping part 404; a sheet end portion gripping part (holding part) 405; and a nozzle (nozzle part) 406 which are respectively connected to the base part 402.

The base part 402 includes: a plate-like base plate 402*a* extending in a longitudinal direction of the base part 402; and a pair of upright walls 402*b*, 402*b* which extends in a direction orthogonal to the base plate 402*a* from both edges of the base plate 402*a* in a width direction.

(Pawl Part and Used Roll Gripping Parts)

The pawl part 403 and the used roll gripping part 404 are provided for removing a used roll 10 from the roll holding shaft 21 of the sheet-feeding device 2.

The pawl part 403 is a plate-like member which is mounted on a distal end of the base plate 402*a* (an end portion of the base plate 402*a* on a side opposite to the head 43*e* in a longitudinal direction of the base plate 402*a*) and extends in a direction opposite to an extending direction of the upright wall 402*b*. On a distal end of the pawl part 403 (an end portion of the pawl part 403 on a side opposite to the base plate 402*a* in an extending direction of the pawl part 403), a cutout 403*a* which is indented toward a base plate 402*a* side is formed.

The used roll gripping part 404 is mounted on a proximal end of the base plate 402*a* (an end portion of the base plate 402*a* on a head 43*e* side in the longitudinal direction of the base plate 402*a*). The used roll gripping part 404 has a pair of used roll sandwiching parts 404*a* which opposedly faces each other in a width direction of the base plate 402*a*. These used roll sandwiching parts 404*a* are driven in a direction that the used roll sandwiching parts 404*a* approach each other or in a direction that the used roll sandwiching parts 404*a* are separated from each other by a driving device not shown in the drawing (for example, a device which pneumatically drives the used roll sandwiching parts 404*a*).

The used original sheet roll 10 is removed from the roll holding shaft 21 of the sheet-feeding device 2 in accordance with the following steps.

First, a distal end portion of the pawl part 403 is inserted into a gap between the used original sheet roll 10 held on the roll holding shaft 21 and the support wall 2*a*, and the roll holding shaft 21 is inserted into the cutout 403*a*. Next, the head 43*e* is moved in a direction away from the support wall 2*a* so that the used original sheet roll 10 is pulled out in the direction away from the support wall 2*a*. Then, the used roll 10 is sandwiched by the used roll sandwiching parts 404*a*, and the head 43*e* is moved in the direction away from the support wall 2*a* in such a sandwiched state. By such an operation, the used original sheet roll 10 is removed from the roll holding shaft 21. The removed original sheet roll 10 is conveyed to a discarding place (not shown in the drawing) and is discarded.

(Sheet End Portion Gripping Part)

The sheet end portion gripping part 405 is provided for holding and conveying the joining end portion 13.

The sheet end portion gripping part 405 includes: a pair of holding pads 410, 410; and suction pipes 420, 420 which are respectively fixed to the respective holding pads 410.

Figure 9:
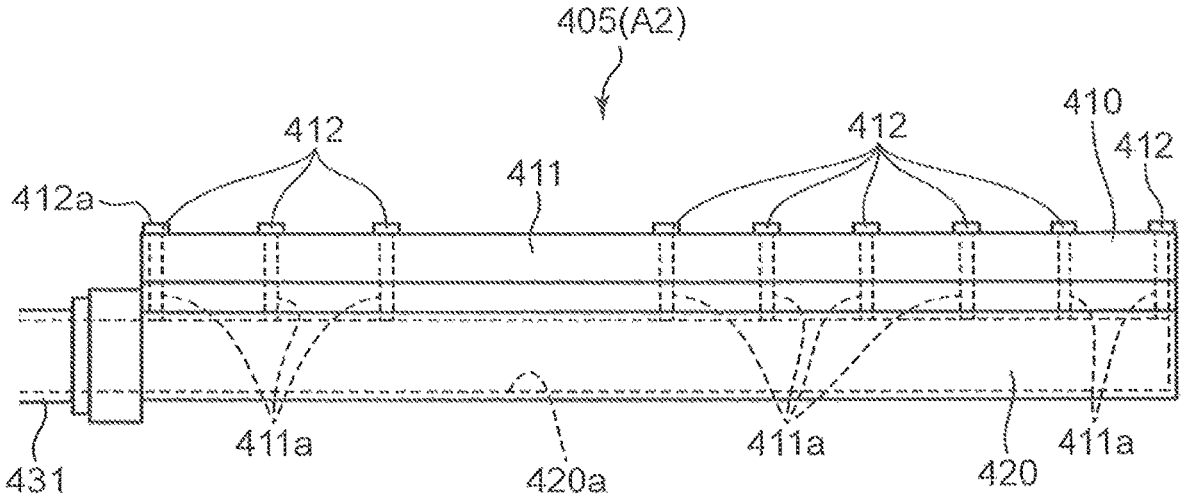
FIG. 9 is a schematic view showing a holding pad and a suction pipe.

The holding pads 410, 410 are symmetrically disposed with each other with respect to a plane passing through the fourth axis J4 and the fifth axis J5, and the suction pipes 420, 420 are symmetrically disposed with each other with respect to such a plane. FIG. 9 is a schematic view of one holding pad 410 and one suction pipe 420 as viewed in an arrow IX direction in FIG. 8.

The holding pad 410 has: a body portion 411 extending in a direction parallel to the fifth axis J5; and a plurality of suction portions 412 formed on one side surface of the body portion 411 extending in a longitudinal direction of the body portion 411.

The respective suction portions 412 are formed at positions spaced apart from each other in a direction parallel to the fifth axis J5 respectively. A surface of each of the respective suction portions 412 has an approximately flat planar shape, and functions as a holding surface 412*a* for sucking the joining end portion 13. In the respective suction portions 412, a hole which opens at the holding surface 412*a* is formed respectively. On respective portions of the body portion 411 where the suction portions 412 are arranged, a suction hole 411*a* which communicates with the hole of the corresponding suction portion 412 is formed respectively.

The suction pipe 420 has a circular columnar shape extending parallel to the holding pad 410, and is connected to a side surface of the holding pad 410 on a side opposite to the side surface where the suction portions 412 are formed. In the suction pipe 420, an air passage 420*a* which extends in an axial direction of the suction pipe 420 and communicates with the respective suction holes 411*a* is formed. The air passage 420*a* is connected with a sheet end portion suction pump 432 (a suction mechanism, see FIG. 13) which is a pump for sucking air by way of an air pipe 431. Air in the air passage 420*a*, the suction holes 411*a*, and holes formed in the respective suction portions 412 is sucked by the sheet end portion suction pump 432.

The respective holding pads 410 and the suction pipes 420 respectively connected to the respective holding pads 410 are respectively rotatably connected to the base part 402 about a sixth axis J6 (a rotation center axis) extending in a direction parallel to the fifth axis J5 and a seventh axis J7 (a rotation center axis) extending in a direction parallel to the fifth axis J5. The respective holding pads 410 and the suction pipes 420 are rotated between a second posture A2 indicated by a solid line in FIG. 6 and a first posture A1 indicated by a chain line in FIG. 6. This structure is described specifically hereinafter. In the description made hereinafter, an up-and-down direction in FIG. 6 is simply referred to as a vertical direction, and a left-and-right direction in FIG. 6 is simply referred to as a lateral direction.

As shown in FIG. 8 and the like, extending walls 407 extending downward are fixed to a lower surface of the base plate 402*a*. Two extending walls 407, 407 are mounted at positions away from each other in the longitudinal direction of the base plate 402*a*. To both end portions of a lower end portion of each extending wall 407 in a lateral direction, connecting portions 408 extending in a vertical direction are respectively connected. Holding pads 410 are fixed to the lower end portions of these connecting portions 408. That is, one holding pad 410 is fixed to lower end portions of two connecting portions 408 respectively connected to right lower end portions of two extending walls 407, and the other holding pad 410 is fixed to lower end portions of two connecting portions 408 respectively connected to left lower end portions of two extending walls 407.

Two connecting portions 408 positioned on a right side are rotatably connected to the extending wall 407 about the sixth axis J6, and two connecting portions 408 positioned on a left side are rotatably connected to the extending wall 407 about the seventh axis J7. With such a configuration, the holding pad 410 positioned on a right side and the suction pipe 420 fixed to the right holding pad 410 rotate integrally with the right extending wall 407 about the sixth axis J6. The holding pad 410 positioned on a left side and the suction pipe 420 fixed to the left holding pad 410 rotate integrally with the left extending wall 407 about the seventh axis J7.

The respective connecting portions 408 are rotatably driven by a pad rotating mechanism 440 mounted on the base part 402 (see FIG. 13).

In this embodiment, the pad rotating mechanism 440 is configured to rotate the respective connecting portions 408 by 90 degrees. That is, the pad rotating mechanism 440 is configured to rotate the connecting portions 408 between a state where the respective connecting portions 408 extend downward from the extending wall 407 as indicated by the solid line in FIG. 6 and a state where the respective connecting portions 408 extend outward in the lateral direction respectively from the extending wall 407 (a state where the right connecting portion 408 extends rightward from the extending wall 407 and the left connecting portion 408 extends leftward from the extending wall 407) as indicated by the chain line in FIG. 6. With such a configuration, a posture of each of the respective holding pads 410 and a posture of each of the respective suction pipes 420 are changed between the first posture A1 and the second posture A2.

As shown in FIG. 6, the respective holding pads 410 are connected to the base part 402 such that, in a state where the holding pads 410 are in the second posture A2, the holding surfaces 412*a* of the holding pads 410 extend in the vertical direction, and the holding surfaces 412*a* take a posture where the holding surfaces 412*a* opposedly face each other at a position where the holding surfaces 412*a* are made close to each other. The respective suction pipes 420 are fixed to the holding pads 410 respectively such that the respective suction pipes 420 are positioned at left and right outer sides of the holding pads 410 in a state where the suction pipes 420 are in the second posture A2. Further, due to the above-mentioned configuration where the connecting portions 408 are rotatable by 90 degrees, when the holding pads 410 are in the second posture A2, the holding surfaces 412*a* of the respective holding pads 410 are separated from each other by 180 degrees, and are brought into a state where the holding surfaces 412*a* extend along the same plane.

In this manner, in this embodiment, the holding pads 410 are supported on the head 43*e* by way of the base part 402 and the extending walls 407, and the base part 402 and the extending walls 407 function as a support part for supporting the holding pads 410. The suction pipes 420, the sheet end portion suction pump 432 connected to the suction pipes 420 and the like function as a suction mechanism for sucking the joining end portion 13 to the holding surface 412*a*. The pad rotating mechanism 440 functions as a sandwiching mechanism for changing a posture of the holding pads 410 with respect to the base part 402 and the extending walls 407. A unit including the support part, the suction mechanism and the sandwiching mechanism functions as a holding part and a holding unit capable of holding the sheet 12, particularly, the joining end portion 13, that is, the end portion 13 of the sheet 12. The traveling motor 42*a* and the operation robot drive motor 401 function as a moving mechanism capable of moving the holding unit.

A pair of sheet end portion pressing portions 450, 450 is provided to the sheet end portion gripping part 405. These sheet end portion pressing portions 450 are provided for arranging the joining end portion 13 at a proper position in the joining parts 30. As shown in FIG. 6, these sheet end portion pressing portions 450 are plate-like members which protrude downward from the holding pads 410 and extend along the longitudinal direction of the holding pads 410 in a state where the respective holding pads 410 are in the second posture A2. The sheet end portion pressing portions 450 are respectively fixed to the holding pads 410 in an integrally movable state.

(Nozzle)

Figure 10:
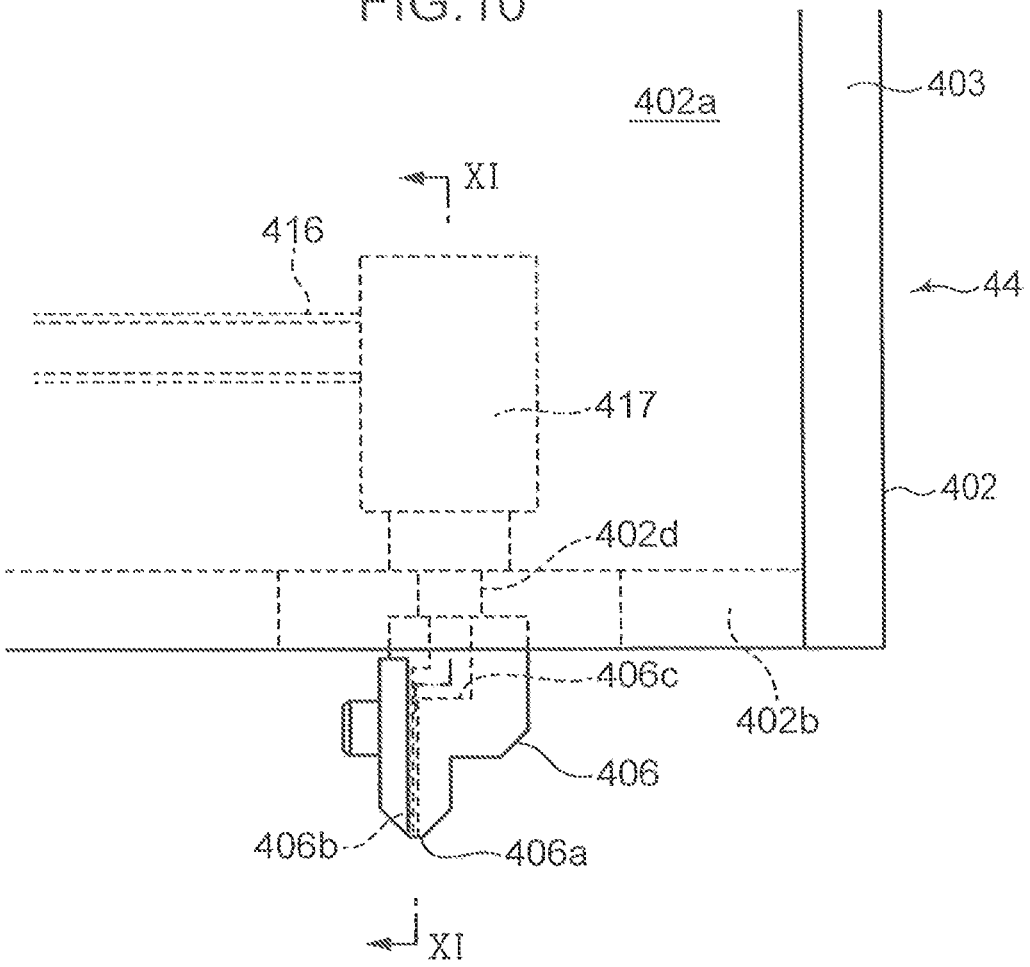
FIG. 10 is a plan view showing a part of the configuration in FIG. 7 in an enlarged manner.
Figure 11:
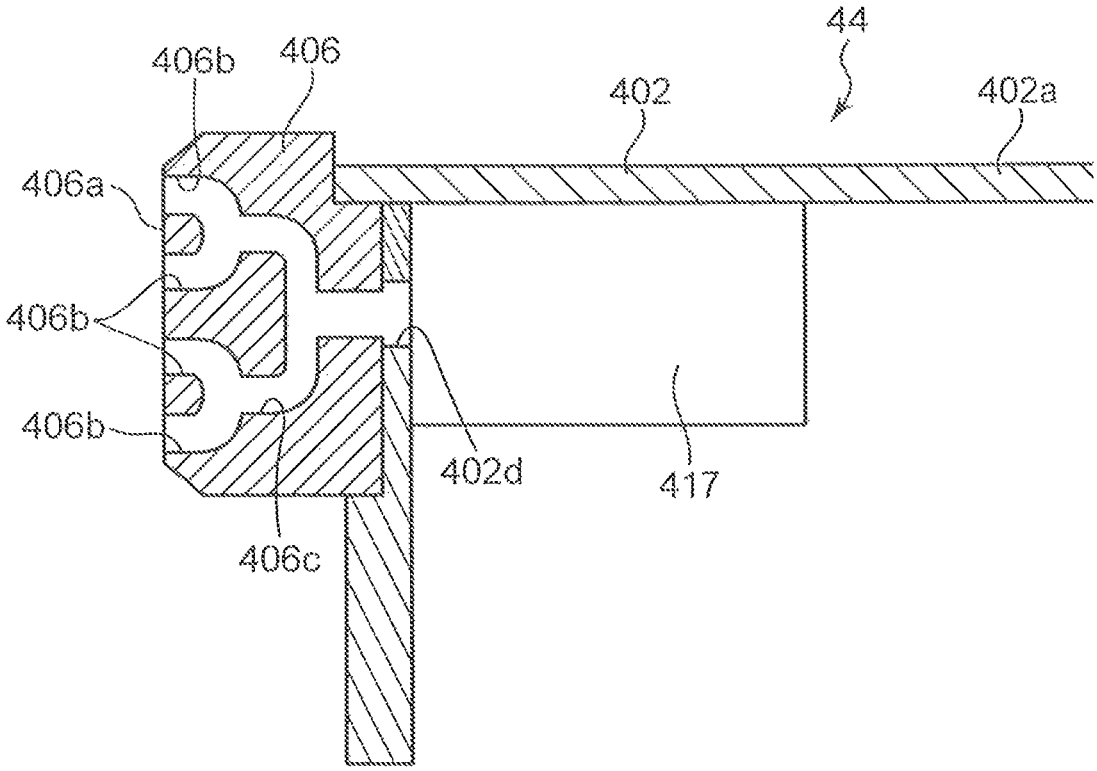
FIG. 11 is a cross-sectional view taken along a line XI-XI in FIG. 10.

FIG. 10 is a plan view showing a part of the hand 44 in an enlarged manner. FIG. 11 is a cross-sectional view taken along a line XI-XI in FIG. 10. In the description of a nozzle 406 made hereinafter, the up-and-down direction in FIG. 6 is simply referred to as a vertical direction, and the left-and-right direction in FIG. 6 is simply referred to as a lateral direction.

The nozzle 406 is provided for applying an adhesive agent by coating to the joining end portion 13. The nozzle 406 is fixed to the base part 402 in a state where the nozzle 406 protrudes from one upright wall 402*b* of the base part 402 in a direction away from the base part 402. In an example shown in FIG. 6, the nozzle 406 protrudes leftward from the left upright wall 402*b*.

The nozzle 406 has: a planar coating surface 406*a* which extends substantially parallel to the upright wall 402*b* at a distal end portion of the nozzle 406 (an end portion on a side opposite to the upright wall 402*b* in a direction orthogonal to the upright wall 402*b*); and a plurality of nozzle holes 406*b* which are formed in the nozzle 406 and open at the coating surface 406*a*. The coating surface 406*a* has an approximately rectangular shape extending in the vertical direction, and the respective nozzle holes 406*b* are formed side by side in the vertical direction on the coating surface 406*a*.

In this embodiment, four nozzle holes 406*b* are formed in the nozzle 406, and these four nozzle holes 406*b* are arranged side by side in the vertical direction and open at the coating surface 406*a*.

In the nozzle 406, an adhesive agent supply passage 406*c* which communicates with the respective nozzle holes 406*b* is formed. In this embodiment, the adhesive agent supply passage 406*c* is a passage which opens at one side surface of the nozzle 406 on an upright wall 402*b* side, and is bifurcated into two passages in the nozzle 406, and two nozzle holes 406*b* communicate with each bifurcated passage.

The adhesive agent supply passage 406*c* communicates with an adhesive agent supply pipe 416 which is fixed to a lower surface of the base plate 402*a* by way of an adhesive agent discharge valve 417 and a through hole 402*d* formed in the upright wall 402*b*. The adhesive agent supply pipe 416 is connected to a pump (adhesive agent pump) 418*b* (see FIG. 1) for pressure-feeding an adhesive agent from a tank 418*a* (see FIG. 1) in which the adhesive agent is reserved. The adhesive agent is pressure-fed to the adhesive agent supply pipe 416 from the tank 418*a* by the adhesive agent pump 418*b*, and is discharged to the outside of the nozzle 406 through the adhesive agent supply passage 406*c* and the nozzle holes 406*b*. The adhesive agent discharge valve 417 is provided for opening or closing a communication portion between the adhesive agent supply passage 406*c* and the adhesive agent supply pipe 416. Only when the adhesive agent discharge valve 417 is opened, the adhesive agent is introduced into the adhesive agent supply passage 406*c* from the adhesive agent supply pipe 416, and is discharged from the nozzle 406.

In this embodiment, the adhesive agent supply pipe 416, the adhesive agent discharge valve 417 and the adhesive agent pump 418*b* function as a discharge mechanism capable of discharging the adhesive agent trough the nozzle 406.

As described later, the nozzle 406 applies the adhesive agent by coating to the joining end portion 13 in a state where the joining end portion 13 is held by the temporary holding part 304 of the joining device 32 of the joining part 30. The nozzle 406 can move to positions corresponding to the temporary holding part 304 of all joining part 30 mounted on the sheet-feeding device 2 along with the movement of the operation robot 4, the head 43*e* and the hand 44, and can apply the adhesive agent by coating to all the joining end portions 13 of the original sheet rolls 10 held by the sheet-feeding device 2.

(Roll Conveying Holding Part)

In this embodiment, as shown in FIG. 2, a roll conveying holding part 49 is mounted on the head 43*e*. The roll conveying holding part 49 protrudes from the head 43*e* toward a side opposite to the hand 44. The roll conveying holding part 49 is provided for conveying the original sheet roll 10. That is, in this embodiment, the original sheet roll 10 is conveyed by the operation robot 4, and the original sheet roll 10 is conveyed from a storage place to the sheet-feeding device 2 in a state where the original sheet roll 10 is held by the roll conveying holding part 49.

(3) Cleaning Unit

Figure 12:
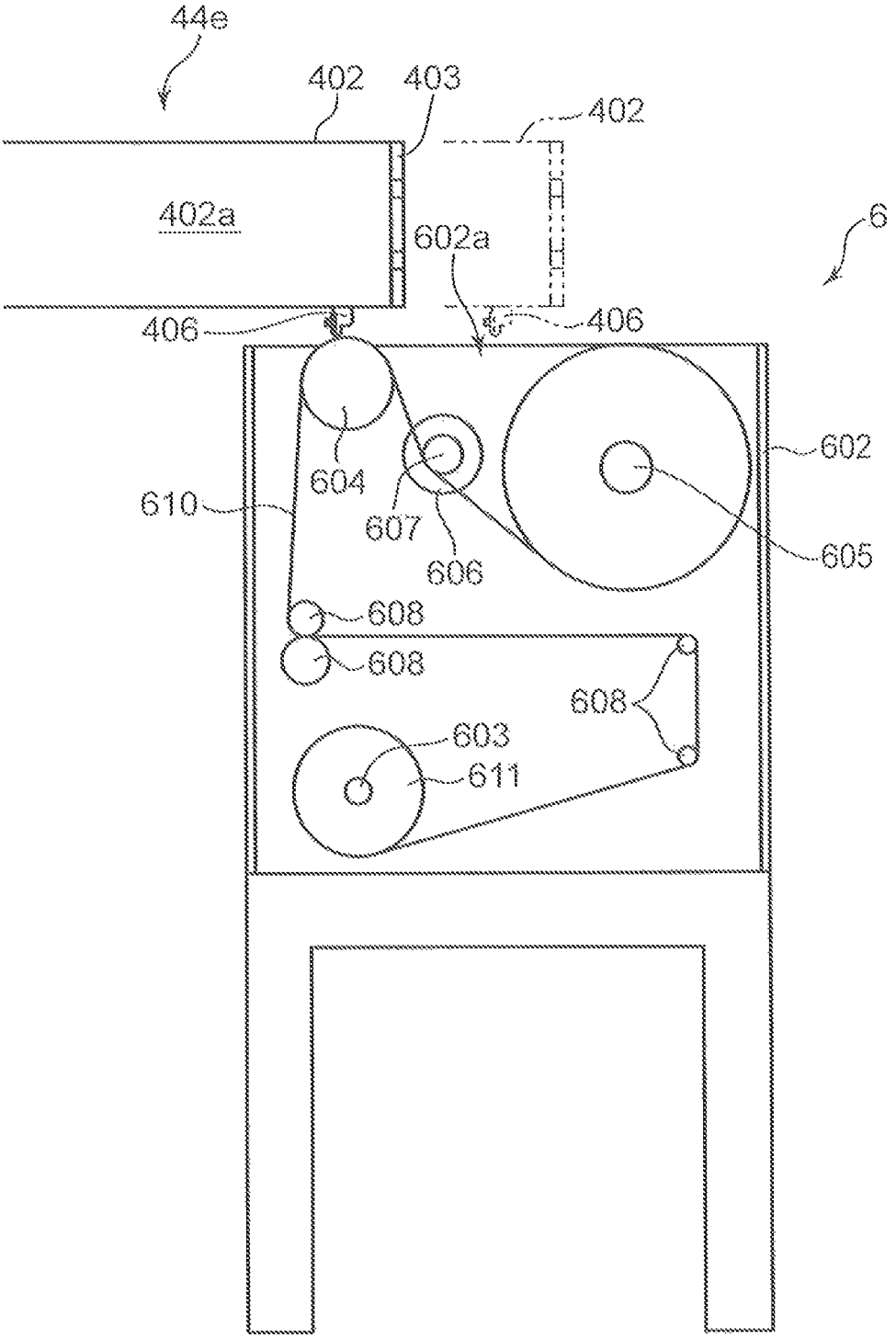
FIG. 12 is a cross-sectional view taken along a line XII-XII in FIG. 1.

The cleaning unit 6 is provided for wiping off an adhesive agent adhering to the nozzle 406. FIG. 12 is a cross-sectional view taken along a line XII-XII in FIG. 1. In this embodiment, the cleaning unit 6 wipes off the adhesive agent adhering to the nozzle 406 using a wiping sheet 610.

As shown in FIG. 12, the cleaning unit 6 includes a casing 602 which opens upward. The cleaning unit 6 also includes a wiping sheet-feeding roller (supply part) 603, a cleaning roller 604, a wiping sheet winding roller (recovery part) 605, a rotatably driving part 606, a draw roller 607, and a plurality of wiping sheet guide portions 608 which are arranged in the casing 602 and are supported by the casing 602 respectively.

The wiping sheet-feeding roller 603 is a member for supporting the wiping sheet 610 in a feedable state. That is, the wiping sheet 610 is wound around the wiping sheet-feeding roller 603 in a roll shape, and the wiping sheet-feeding roller 603 supports the roll 611.

The wiping sheet-feeding roller 603 has an approximately circular columnar shape extending in a direction orthogonal to a paper surface on which FIG. 12 is drawn, and supports the roll 611 by being inserted into the center of the roll 611 of the wiping sheet 610.

The wiping sheet winding roller 605 is a member for winding the wiping sheet 610 which is fed from the wiping sheet-feeding roller 603 and wipes off an adhesive agent using the cleaning roller 604 as described later. The wiping sheet winding roller 605 has an approximately circular columnar shape extending in a direction parallel to a center axis of the wiping sheet-feeding roller 603. The wiping sheet winding roller 605 recovers the wiping sheet 610 by winding the wiping sheet 610 around an outer peripheral surface thereof.

The rotatably driving part 606 rotatably drives the draw roller 607 about a center axis of the draw roller 607, and includes a motor and the like, for example. When the draw roller 607 is rotatably driven by the rotatably driving part 606, the draw roller 607 conveys the wiping sheet 610 by a predetermined length. The rotatably driving part 606 and the wiping sheet winding roller 605 are operated interlockingly. Accordingly, when the draw roller 607 conveys the wiping sheet 610, the wiping sheet winding roller 605 winds the wiping sheet 610 on an outer peripheral surface thereof.

When the draw roller 607 winds the upstream-side wiping sheet 610 and feeds the wiping sheet 610 to a downstream side, the wiping sheet 610 is newly fed from the wiping sheet-feeding roller 603. In this manner, the wiping sheet 610 is conveyed from the wiping sheet-feeding roller 603 toward the wiping sheet winding roller 605 through the draw roller 607 so that the wiping sheet 610 on the cleaning roller 604 which opposedly faces the nozzle 406 is renewed.

The cleaning roller 604 is a member for bringing the wiping sheet 610 and the nozzle 406 into contact with each other. The cleaning roller 604 is disposed downstream of the wiping sheet-feeding roller 603 and upstream of the wiping sheet winding roller 605 in a conveyance direction (feeding direction) of the wiping sheet 610.

The cleaning roller 604 has an approximately circular columnar shape extending in a direction parallel to a center axis of the wiping sheet-feeding roller 603. The cleaning roller 604 is supported on the casing 602 such that an upper outer peripheral surface thereof is positioned above an upper edge of the casing 602.

The wiping sheet 610 is placed on the upper outer peripheral surface of the cleaning roller 604, and as shown in FIG. 12, the nozzle 406 is brought into pressure contact with the wiping sheet 160 placed on the upper outer peripheral surface of the cleaning roller 164. As described later, the nozzle 406 is driven so as to move along the wiping sheet 610 on the outer peripheral surface of the cleaning roller 164. By such an operation, the adhesive agent adhering to the nozzle 406 is wiped off by the wiping sheet 160. In this manner, in this embodiment, a portion of the wiping sheet 610 which is placed on the upper outer peripheral surface of the cleaning roller 604 functions as a wiping part for wiping off the adhesive agent adhered to the nozzle 406.

The respective wiping sheet guide portions 608 are provided for guiding the wiping sheet 610 from the wiping sheet-feeding roller 603 to the wiping sheet winding roller 605 along the upper outer peripheral surface of the cleaning roller 604. These wiping sheet guide portions 608 respectively have an approximately circular columnar shape extending in a direction parallel to the center axis of the cleaning roller 604, and the wiping sheet 610 is guided by being extended between the wiping sheet guide portions 608.

An axis of the wiping sheet winding roller 605 is arranged at a position that is below an axis of the cleaning roller 604 and that is spaced apart from the cleaning roller 604 in a direction orthogonal to an axial direction of the cleaning roller 604. That is, when a left-and-right direction in FIG. 12 is simply referred to as a lateral direction, the wiping sheet winding roller 605 is arranged on a right oblique lower side of the cleaning roller 604, and the wiping sheet 610 is conveyed in a right oblique downward direction from the cleaning roller 604.

The casing 602 opens upward also at the portion between the cleaning roller 604 and the wiping sheet winding roller 605. The opening portion functions as a discarding part 602*a* where discarding by the nozzle 406 is performed. That is, although the description will be made in detail later, in this embodiment, an adhesive agent is discharged from the nozzle 406 at the discarding part 602*a* so that the adhesive agent in the nozzle 406 is removed by making the adhesive agent fall downward.

(4) Controller

The controller 100 is provided for controlling driving of the sheet-feeding device 2, the operation robot 4 and the like based on detection results of the remaining sheet amount detector 28 and a sheet end portion detector 29 and the like. The controller 100 includes: a sheet-feeding device controller 101; and an operation robot controller 102 as functional parts.

The sheet end portion detector 29 is a device for detecting the end portion 13 on the outer peripheral surface of the sheet 12, that is, the joining end portion 13. The sheet end portion detector 29 detects the joining end portion 13 in the course of conveying the original sheet roll 10 from the storage place to the sheet-feeding device 2, for example. The sheet end portion detector 29 also identifies the position of the joining end portion 13 by detecting a shadow formed on the outer peripheral surface by irradiating the outer peripheral surface of the original sheet roll 10 with light, for example.

The sheet-feeding device controller 101 is a part for controlling respective parts of the sheet-feeding device 2. That is, the sheet-feeding device controller 101 controls: the roll holding shaft drive motors 22 (roll holding shafts 21); the joining mechanism rotating valve 302 (joining mechanism rotating cylinder 301); the first to third joining control valves 324 to 326 (first to third joining cylinders 314 to 316); and the joining suction device 334.

The operation robot controller 102 is a part for controlling the operation robot 4. That is, the operation robot controller 102 controls driving of the traveling motor 42*a*, the operation robot drive motor 401, the sheet end portion suction pump 432, the pad rotating mechanism 440, the adhesive agent discharge valve 417, and the adhesive agent pump 418*b*.

(4-1) Steps of Joining Operation

Figure 16:
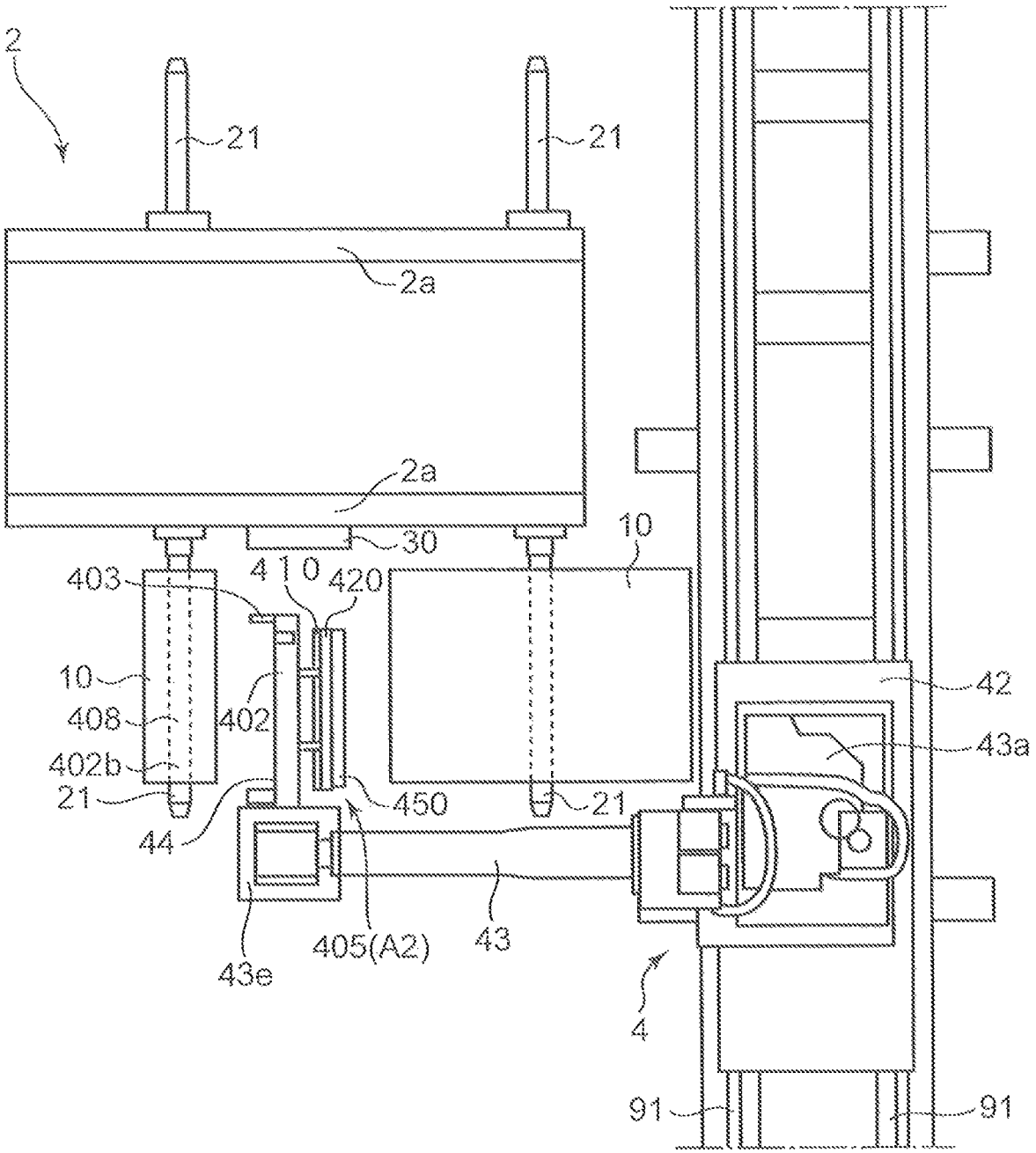
FIG. 16 is a view showing a state where the hand is arranged at a sheet end portion gripping preparation position.
Figure 17:
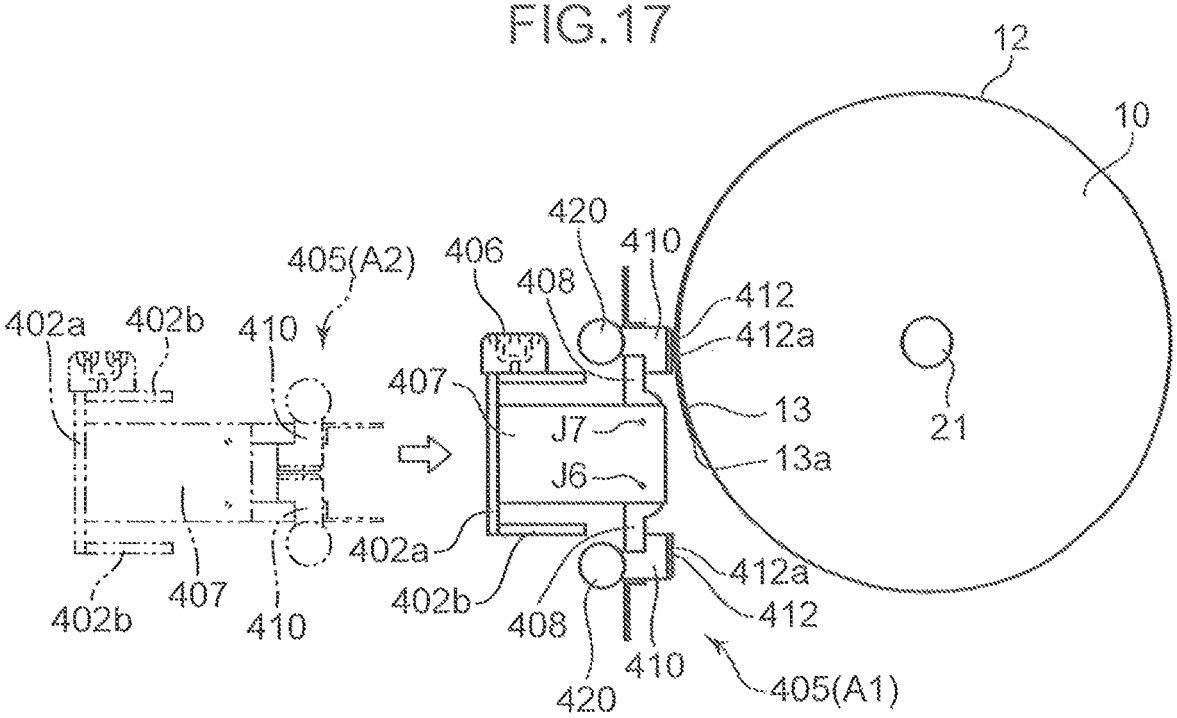
FIG. 17 is a view showing a manner of operation when the holding pad sucks a joining end portion.

Steps of the sheet-feeding method for continuously feeding the sheet 12 using the sheet-feeding system 1 and steps of joining control which the controller 100 performs at the time of joining operation are described hereinafter with reference to flowcharts shown in FIG. 14 and FIG. 15, and FIG. 16 to FIG. 28. Hereinafter, the original sheet roll 10 from which the sheet 12 is fed is referred to as a feeding-side original sheet roll 10, and the original sheet roll 10 from which the sheet 12 is not fed is referred to as a standby-side original sheet roll 10. With respect to various kinds of devices, the devices corresponding to the feeding-side original sheet roll 10 are referred to as feeding-side devices, and the devices corresponding to the standby-side original sheet roll 10 are referred to as standby-side devices respectively. FIG. 16 shows the case where the left original sheet roll 10 is the feeding-side original sheet roll 10 and the right original sheet roll 10 is the standby-side original sheet roll 10 on the rear support wall 2*a*. However, the feeding-side original sheet roll 10 is sequentially switched between two original sheet rolls 10.

First, the controller 100 determines whether or not a sheet joining condition is established in step S1, that is, whether or not a remaining amount of the sheet 12 on the feeding-side original sheet roll 10 detected by the remaining sheet amount detector 28 is equal to or less than a preset reference sheet amount (a predetermined remaining amount).

Specifically, as described above, first, the controller 100 calculates a remaining amount of the sheet 12 based on a detection result of the remaining sheet amount detector 28, and then determines whether or not the calculated remaining amount of the sheet 12 is equal to or less than the reference sheet amount.

When the determination in step S1 is NO and the remaining amount of the sheet 12 on the feeding-side original sheet roll 10 is larger than the reference sheet amount, a joining operation is not performed, and processing returns to step S1.

On the other hand, when the determination result in step S1 is YES and the remaining amount of the sheet 12 on the feeding-side original sheet roll 10 is equal to or less than the reference sheet amount, the controller 100 advances processing to step S2 so as to start a joining operation.

In step S2, the controller 100 arranges the standby-side joining mechanism (the joining mechanism corresponding to the standby-side original sheet roll 10) 300 at the joining preparation position. Specifically, as described above, the controller 100 rotates the joining mechanism 300 from the feeding position to the joining preparation position by driving the joining mechanism rotating valve 302, that is, the joining mechanism rotating cylinder 301.

Next, in step S3, the controller 100 starts suction of the joining suction surface 304*a* of the standby-side joining mechanism 300 by driving the joining suction device 334.

Next, in step S4, the controller 100 moves the hand 44 to the sheet end portion gripping preparation position.

Specifically, the controller 100 sets the position of the hand 44 to the position where the base part 402 extends parallel to the roll holding shafts 21 at the position between two roll holding shafts 21, and the holding pad 410 is arranged more on the standby-side original sheet roll 10 side than the base part 402 as shown in FIG. 16 by driving the traveling motor 42*a* and the operation robot drive motor 401.

Before processing in step S4 is performed, the hand 44 is arranged at the standby position (for example, the position indicated by a solid line in FIG. 1) away from the sheet-feeding device 2.

Next, in step S5, the controller 100 rotates the respective connecting parts 408 of the sheet end portion gripping part 405 by driving the pad rotating mechanism 440 thus bringing the sheet end portion gripping part 405 into the first posture A1. Along with such an operation, as indicated by a solid line in FIG. 17, the respective holding pads 410 of the sheet end portion gripping part 405 are brought into a posture where the holding surface 412*a* of each holding pad 410 faces the standby-side original sheet roll 10. Before processing in step S5 is performed, the sheet end portion gripping part 405 is in the second posture A2.

Next, in step S6, the controller 100 rotatably drives the standby-side roll holding shaft 21 by driving the roll holding shaft drive motor 22 thus arranging the joining end portion 13 to a position opposedly facing the holding surface 412*a* of the holding pad 410 and, then, moves the head 43*e* by driving an operation robot drive motor 401. Then, the holding surface 412*a* of one holding pad 410 is brought into close contact with the end portion 13 of the sheet 12 on the standby-side original sheet roll 10, that is, the joining end portion 13 from the outside of the standby-side original sheet roll 10 in a radial direction of the standby-side original sheet roll 10.

In this stage of operation, in a state where the holding pads 410 are respectively arranged upstream and downstream in the conveyance direction of the sheet 12 with an edge (an edge on a downstream side in the conveyance direction of the sheet 12) 13*a* of the joining end portion 13 sandwiched therebetween, the controller 100 brings the holding surface 412*a* of the holding pad 410 positioned upstream in the conveyance direction of the sheet 12 into close contact with the joining end portion 13.

In this embodiment, the sheet 12 is conveyed from above to below between two roll holding shafts 21, 21, and along with such conveyance, the holding surface 412*a* of the upper holding pad 410 is brought into close contact with the joining end portion 13.

Here, the controller 100 stops movement of the hand 44 when the holding surface 412*a* is brought into contact with the joining end portion 13.

Further, in the above-mentioned description, the description is made with respect to the case where the joining end portion 13 is arranged at the position which opposedly faces the holding surface 412*a* of the holding pad 410 due to the rotation of the standby-side roll holding shaft 21 by driving the roll holding shaft drive motor 22. However, in place of such processing, the original sheet roll 10 may be set to the roll holding shaft 21 in advance such that the pre-detected end portion 13 of the sheet 12 is arranged at a predetermined position opposedly facing the holding surface 412*a*.

Next, in step S7, the controller 100 makes the holding surface 412*a* of the holding pad 410 suck the joining end portion 13. Specifically, the controller 100 starts suction of air in the air passage 420*a* by starting driving of the sheet end portion suction pump 432. By such an operation, the joining end portion 13 is sucked to the holding surface 412*a*. In this embodiment, with respect to two holding pads 410, the suction of air only in the air passage 420*a* of the holding pad 410 which is brought into close contact with the joining end portion 13 (in this embodiment, the upper holding pad 410) is started.

Next, in step S8, the controller 100 rotatably drives the standby-side roll holding shaft (the roll holding shaft which holds the standby-side original sheet roll 10) 21 in a direction that the sheet 12 is fed from the standby-side original sheet roll 10 by driving the roll holding shaft drive motor 22. At this stage of operation, the controller 100 drives the roll holding shaft drive motor 22 in a state where a feeding speed of the sheet 12 on the standby-side original sheet roll 10 is set such that a tension applied to the sheet 12 when the sheet end portion gripping part 405 which holds the joining end portion 13 moves in step S9 and step S11 described later becomes a predetermined tension or less.

Figure 18:
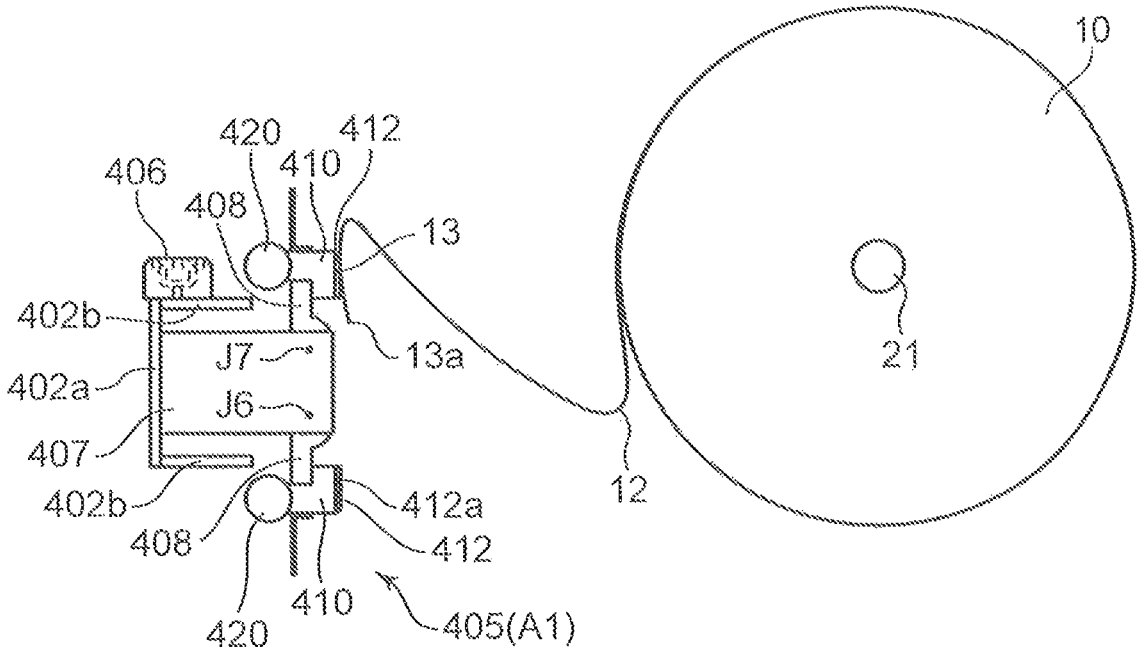
FIG. 18 is a view showing a manner of operation when the holding pad takes out the joining end portion.

Next, in step S9, as shown in FIG. 18, the controller 100 moves the sheet end portion gripping part 405 outside of the standby-side original sheet roll 10 in the radial direction such that the holding surface 412*a* to which the joining end portion 13 is sucked is separated from the standby-side original sheet roll 10. Specifically, the controller 100 moves the head 43*e* outside of the standby-side original sheet roll 10 in the radial direction by driving the operation robot drive motor 401.

At this stage of operation, as described previously, in step S8, the standby-side original sheet roll 10 is rotatably driven in a direction that the sheet 12 is fed. Accordingly, due to processing in step S9, the joining end portion 13 is taken out from the standby-side original sheet roll 10 in a state where the joining end portion 13 is sucked to the holding surface 412*a* without being separated from the holding surface 412*a*.

Figure 19:
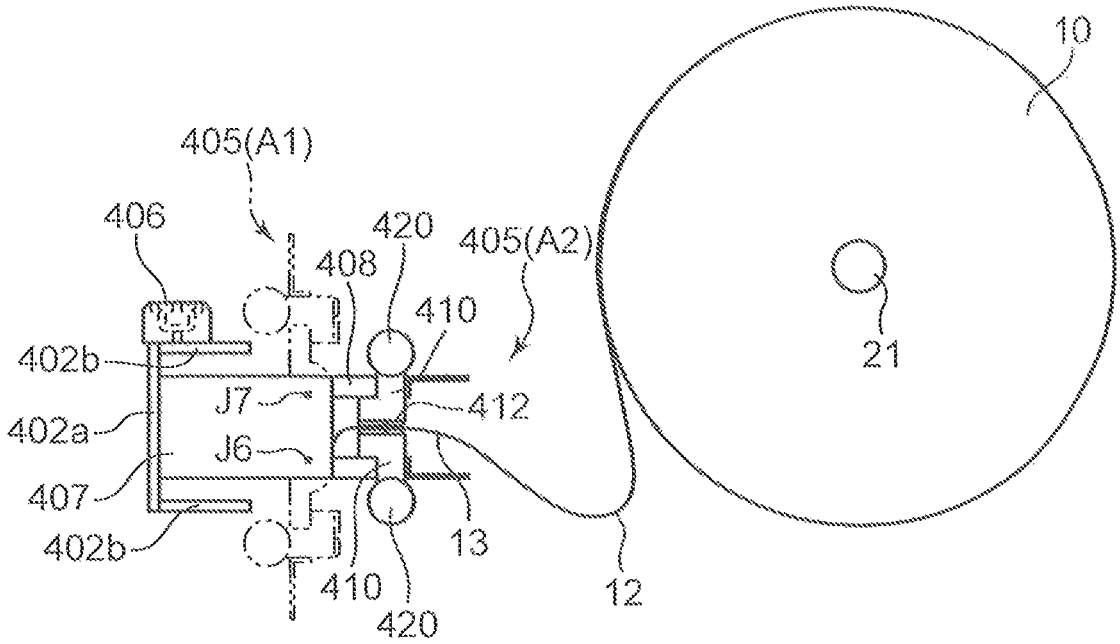
FIG. 19 is a view showing a manner of operation when the holding pad grips the joining end portion.
Figure 20:
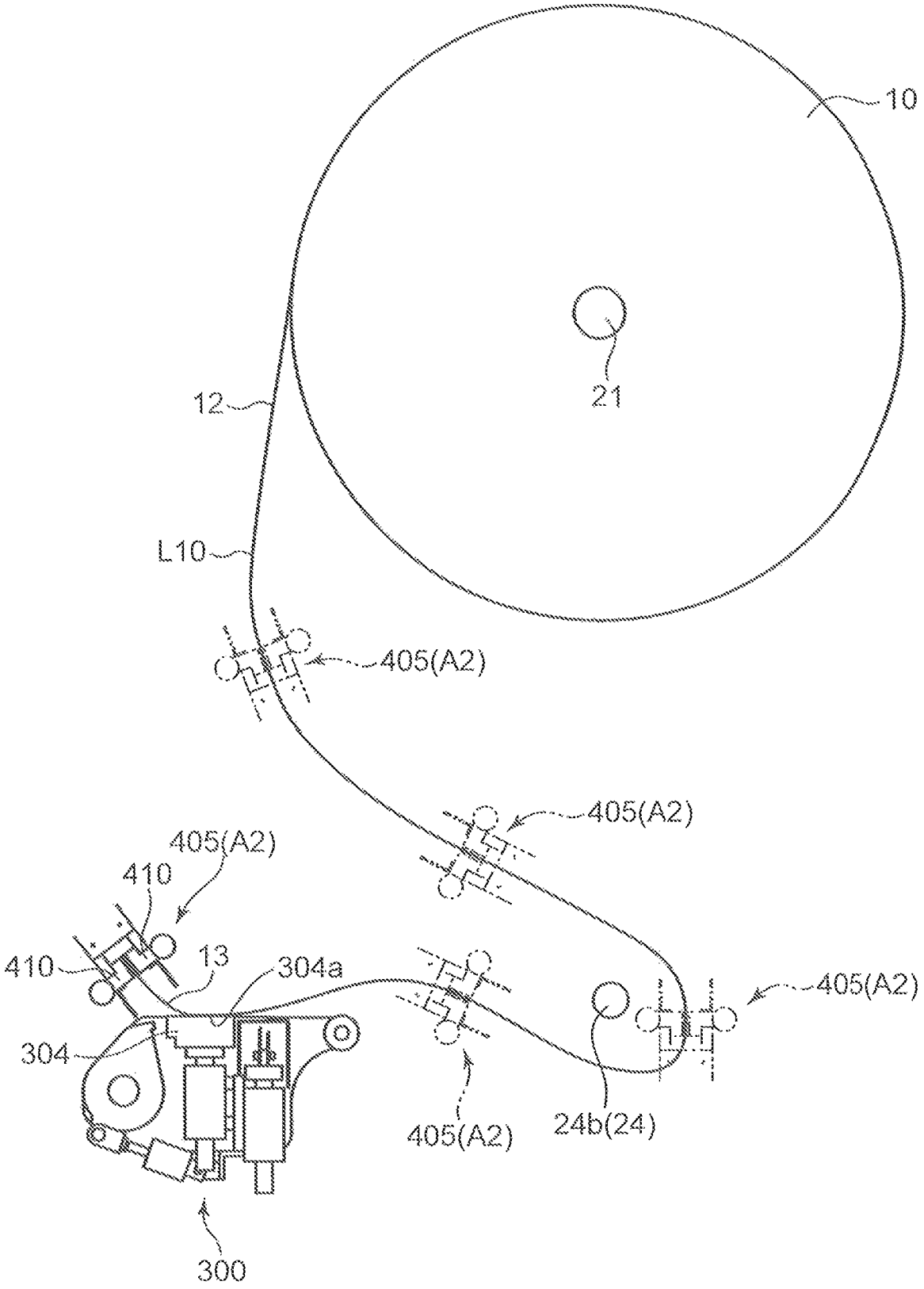
FIG. 20 is a view showing a manner of operation when the joining end portion is conveyed to a joining part.

Next, in step S10, as shown in FIG. 19, the sheet end portion gripping part 405 is brought into the second posture A2, and the joining end portion 13 is gripped by the pair of holding pads 410. Specifically, the controller 100 rotates the respective connecting parts 408 by driving the pad rotating mechanism 440, and brings the sheet end portion gripping part 405 into the second posture A2 in a state where the joining end portion 13 is sucked to the holding surface 412*a* of one holding pad 410.

At this stage of operation, the holding pad 410 to which the joining end portion 13 is not sucked reaches the joining end portion 13 by being rotated upward from the position below the joining end portion 13. That is, the holding pad 410 to which the joining end portion 13 is not sucked moves along a path where the holding pad 410 moves toward an upstream side from a position on a downstream side of the joining end portion 13 with respect to the conveyance direction of the sheet 12, and reaches a back surface (second surface) of the sheet 12 which is a surface on a side opposite to a surface (first surface) of the sheet 12 which is sucked by the other holding pad 410.

Due to processing in step S10, the joining end portion 13 is sandwiched between the pair of holding pads 410. Along with such an operation, the controller 100 stops sucking of the joining end portion 13 by the holding pad 410.

Next, in step S11, the controller 100 conveys the joining end portion 13 to the standby-side joining mechanism 300. Specifically, the controller 100 moves the sheet end portion gripping part 405 along a path L10 shown in FIG. 20 by driving the operation robot drive motor 401 or the like. That is, the controller 100 moves the sheet end portion gripping part 405 along the path L10 which reaches the standby-side joining mechanism 300 through upper, right and lower sides of the guide roller 24*b* in the lateral direction in FIG. 20. Further, the controller 100 moves the sheet end portion gripping part 405 along the joining suction surface 304*a* of the standby-side joining mechanism 300.

Next, in step S12, the controller 100 releases the joining end portion 13, and sets the joining end portion 13 to the standby-side joining mechanism 300.

Figure 21:
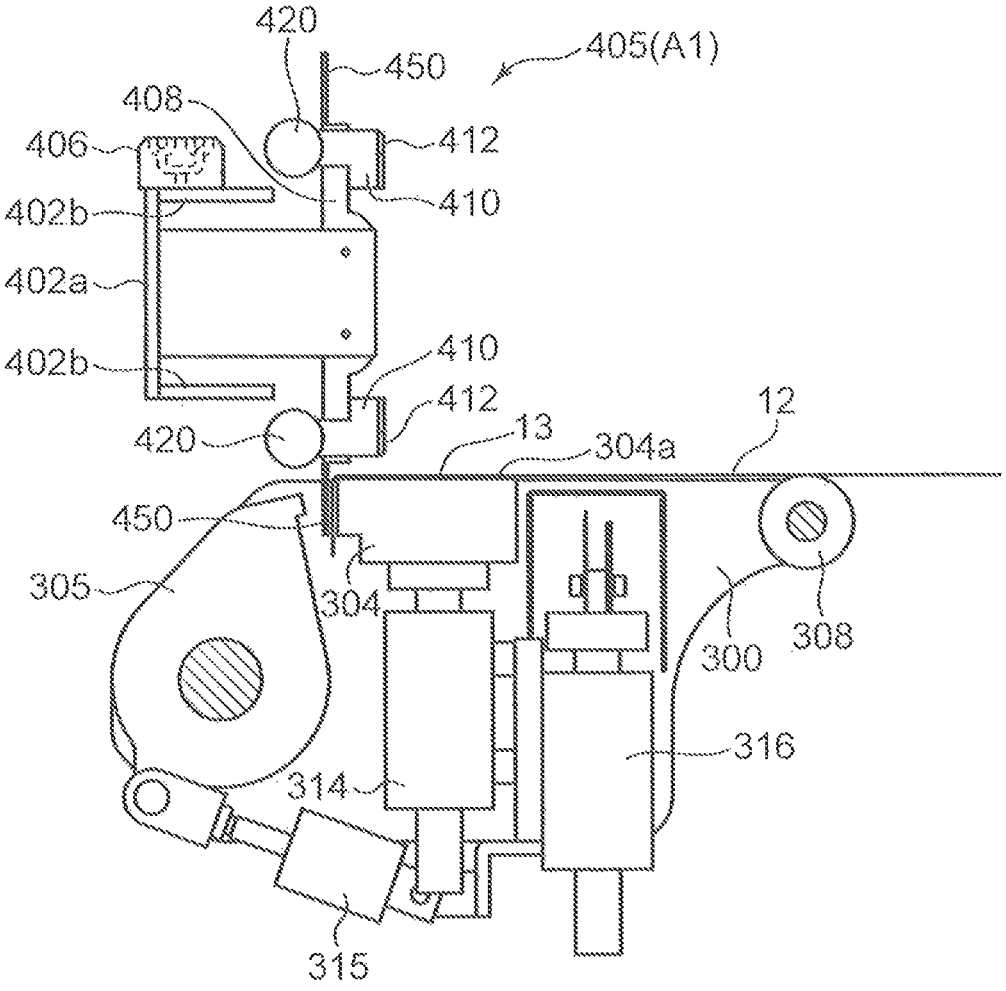
FIG. 21 is a view showing a manner of operation when the joining end portion is set at the joining part.

Specifically, the controller 100 conveys the joining end portion 13 to the position beyond the temporary holding part 304. Next, the controller 100 brings the sheet end portion gripping part 405 into the first posture A1 above the joining suction surface 304*a* by driving the pad rotating mechanism 440. By such an operation, the sheet end portion 13 sandwiched by two holding pads 410 is released from the sheet end portion gripping part 405 and falls on the joining suction surface 304*a*. Then, as shown in FIG. 21, the controller 100 drives the operation robot drive motor 401 or the like so as to move the sheet end portion pressing part 450 downward toward a gap between the temporary holding part 304 and the sheet end portion pressing member 305. By such an operation, the edge portion 13*a* of the sheet end portion 13 is pushed between the temporary holding part 304 and the sheet end portion pressing member 305.

Figure 22:
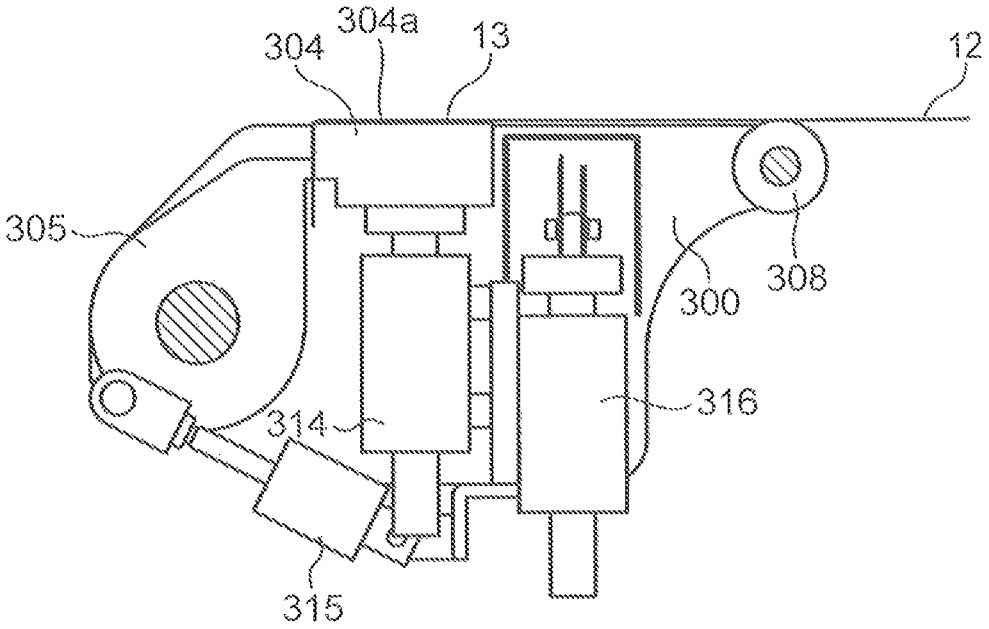
FIG. 22 is a view showing a manner of operation when the joining end portion is set at the joining part.

Next, in step S13, as shown in FIG. 22, the controller 100 fixes the joining end portion 13 to the standby-side joining mechanism 300 by making the sheet end portion pressing member 305 and the temporary holding part 304 clamp the joining end portion 13 therebetween. Specifically, the controller 100 rotates, by driving the second joining control valve 325, that is, the second joining cylinder 315, the sheet end portion pressing member 305 in a direction that the sheet end portion pressing surface 305*a* of the sheet end portion pressing member 305 approaches the surface to be pressed 304*b* whereby the joining end portion 13 is sandwiched between these surfaces 305*a*, 304*b*.

Then, to eliminate loosening of the joining end portion 13 placed on the joining suction surface 304*a*, the controller 100 rotates the standby-side roll holding shaft 21 in a direction that the sheet 12 is wound by suitably driving the roll holding shaft drive motor 22.

In this manner, in steps S10 to S13, a holding part moving step is performed where the sheet end portion gripping part 405 is moved such that the joining end portion 13 is conveyed to the standby-side joining mechanism 330 (to be more specific, the temporary holding part 304 of the standby-side joining mechanism 330) in a state where the joining end portion 13 is held by the sheet end portion gripping part 405.

When the joining end portion 13 is held by the standby-side joining mechanism 330 due to such steps, the controller 100 performs a step of applying an adhesive agent to the joining end portion 13 by coating.

Figure 23:
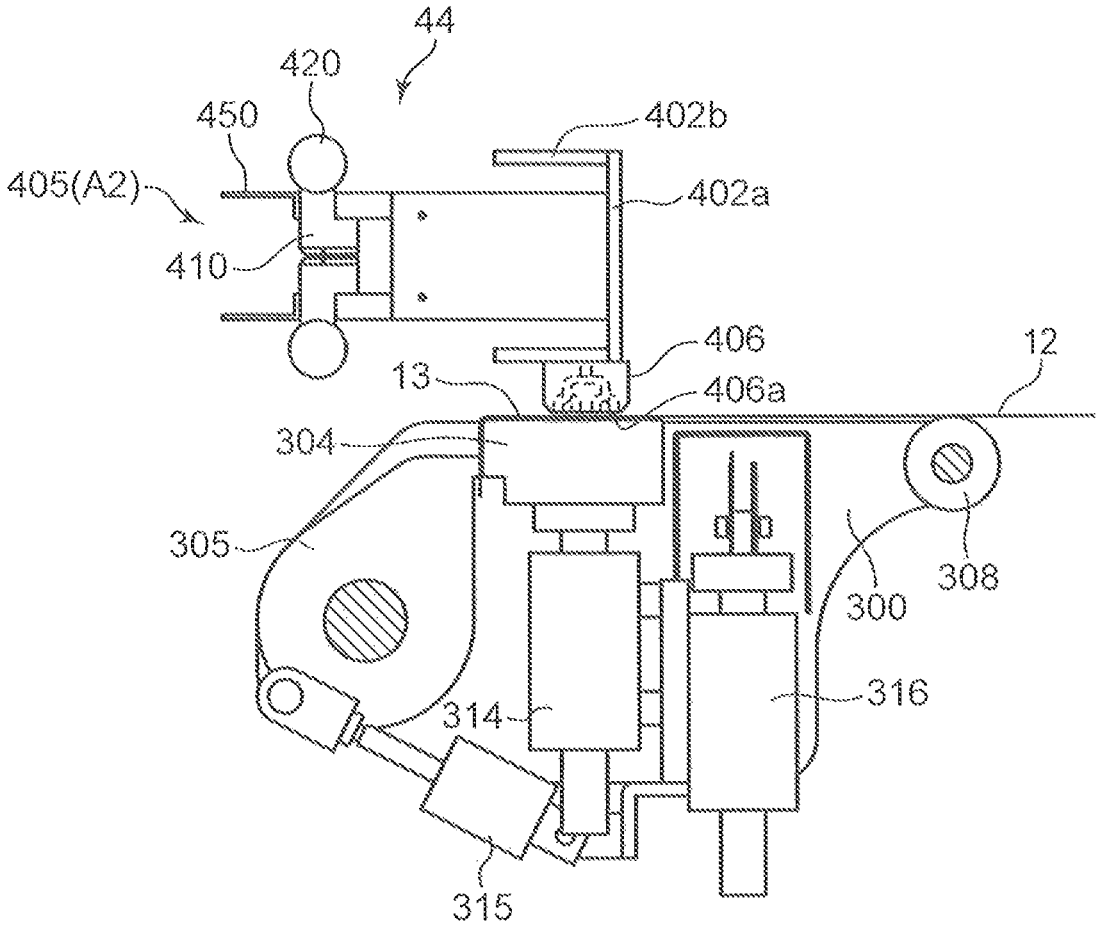
FIG. 23 is a view showing a manner of operation when an adhesive agent is applied by coating to the joining end portion.
Figure 24:
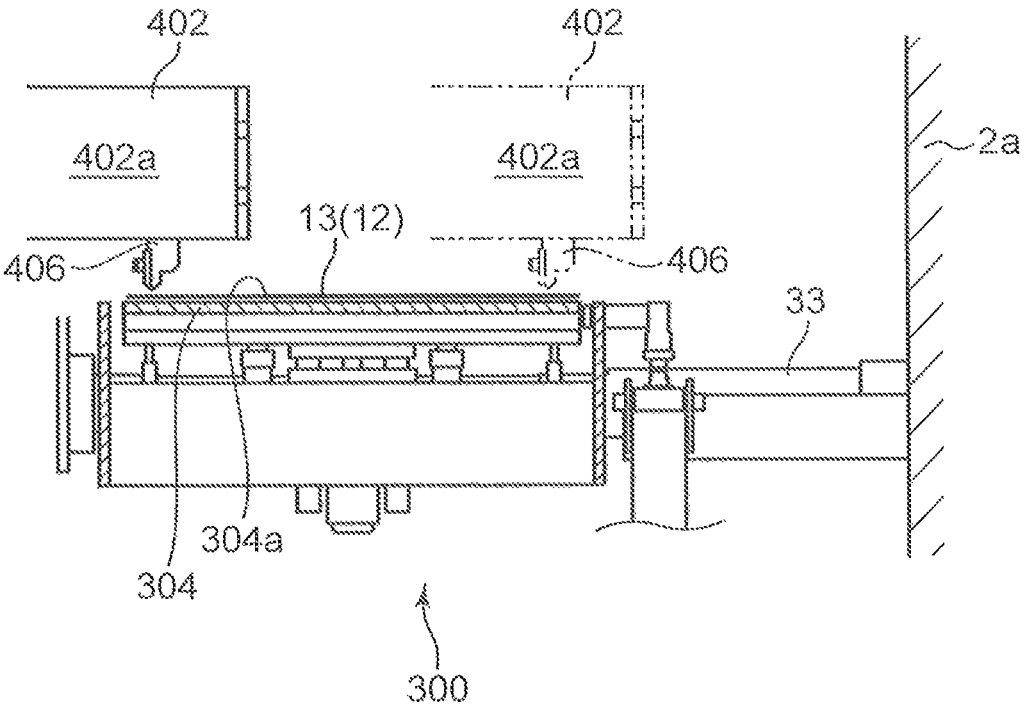
FIG. 24 is a view showing a manner of operation when the adhesive agent is applied by coating to the joining end portion and is a view corresponding to FIG. 4.

First, in step S21, the controller 100 drives the operation robot drive motor 401 so as to arrange the coating surface 406*a* of the nozzle 406 above the joining end portion 13 and to make the coating surface 406*a* opposedly face the joining end portion 13. Specifically, as shown in FIG. 23 and FIG. 24 which is a view corresponding to FIG. 4 and showing a mode where an adhesive agent is applied by coating, the controller 100 moves the head 43*e* such that the nozzle 406 is arranged on one end of the joining end portion 13 in a width direction of the joining end portion 13 and in the vicinity of an end portion of the joining end portion 13 on a side opposite to the support wall 2*a*. At this stage of operation, the controller 100 arranges the nozzle 406 such that four nozzle holes 406*b* are arranged in a row in the longitudinal direction (conveyance direction) of the sheet 12. Further, the controller 100 makes a portion of the joining end portion 13 on the joining suction surface 304*a* and the coating surface 406*a* of the nozzle 406 opposedly face each other.

Next, in step S22, the controller 100 makes the nozzle 406 discharge an adhesive agent to the joining end portion 13. Specifically, the controller 100 drives the adhesive agent pump 418*b* and, at the same time, opens the adhesive agent discharge valve 417. By such an operation, the supply of an adhesive agent from the adhesive agent supply pipe 416 to the inside of the nozzle holes 406*b* and the discharge of the adhesive agent from the nozzle holes 406*b* to the joining end portion 13 are started.

Next, in step S23, in a state where the adhesive agent is discharged from the nozzle 406, the controller 100 moves the nozzle 406 in a width direction of the joining end portion 13 from an area in the vicinity of one end of the joining end portion 13 (in the vicinity of the end portion on a side opposite to the support wall) to an area in the vicinity of the other end portion of the joining end portion 13.

Figure 25:
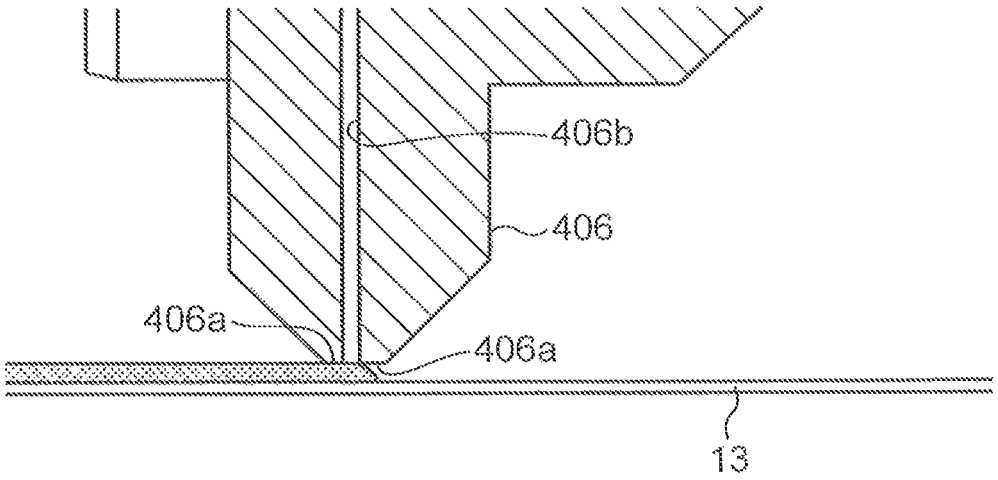
FIG. 25 is a cross-sectional view showing a part of the configuration shown in FIG. 24 in an enlarged manner.

Specifically, the controller 100 drives the operation robot drive motor 401 and the like so as to move, as shown in FIG. 25, the head 43*e* along the width direction of the joining end portion 13 in a state where a distance between the coating surface 406*a* of the nozzle 406 and the joining end portion 13 in the vertical direction is maintained at a fixed distance or in a state where the coating surface 406*a* of the nozzle 406 is brought into slight contact with the joining end portion 13. By such an operation, the adhesive agent is applied by coating to the joining end portion 13 along the width direction of the joining end portion 13.

At this stage of the operation, the controller 100 adjusts a moving speed of the nozzle 406 such that the adhesive agent discharged from the nozzle 406 is applied by coating to the joining end portion 13 at an approximately uniform thickness in the width direction and in a state where the thickness of the applied adhesive agent is suppressed to a relatively small value. Further, a discharge amount of the adhesive agent is also adjusted such that the adhesive agent is applied by coating as described above.

As shown in FIG. 25, the coating surface 406*a*, that is, a coating area which includes an edge of an opening of the nozzle hole 406*b* and by which an adhesive agent is applied by coating extends toward a rear side of the opening of the nozzle hole 406*b* (toward the rear side of the opening of the nozzle hole 406*b* in an advancing direction of the nozzle 406). Particularly, the coating surface 406*a* is formed into a planar shape and hence, the whole portion of the coating surface 406*a* on the rear side of the opening of the nozzle hole 406*b* forms the coating area where an adhesive agent is applied by coating. Accordingly, the adhesive agent discharged from the nozzle 406 is stretched by the coating surface 406*a* so that the adhesive agent is applied by coating uniformly.

Next, in step S24, in a state where the adhesive agent is discharged from the nozzle 406, the controller 100 moves the nozzle 406 along the width direction of the joining end portion 13 from an area in the vicinity of the other end of the joining end portion 13 to one end portion of the joining end portion 13 (in the vicinity of the end portion of the joining end portion 13 on a side opposite to the support wall).

Specifically, the controller 100 moves the nozzle 406 (head 43*e*) away from the joining end portion 13 by moving the nozzle 406 (head 43*e*) upward when the nozzle 406 reaches the area in the vicinity of the other end of the joining end portion 13. Next, the controller 100 translates the nozzle 406 (head 43*e*) toward an upstream side in the conveyance direction of the sheet 12 by an amount equal to or larger than a size of the coating surface 406*a* in the longitudinal direction. Next, the controller 100 makes the nozzle 406 (head 43*e*) approach the joining end portion 13 by moving the nozzle 406 (head 43*e*) downward again. Then, the controller 100 moves the nozzle 406 from the other end to one end of the joining end portion 13.

Next, an adhesive agent is sequentially applied by coating to the sheet end portion 13 from the other end toward one end of the sheet end portion 13.

Figure 26:
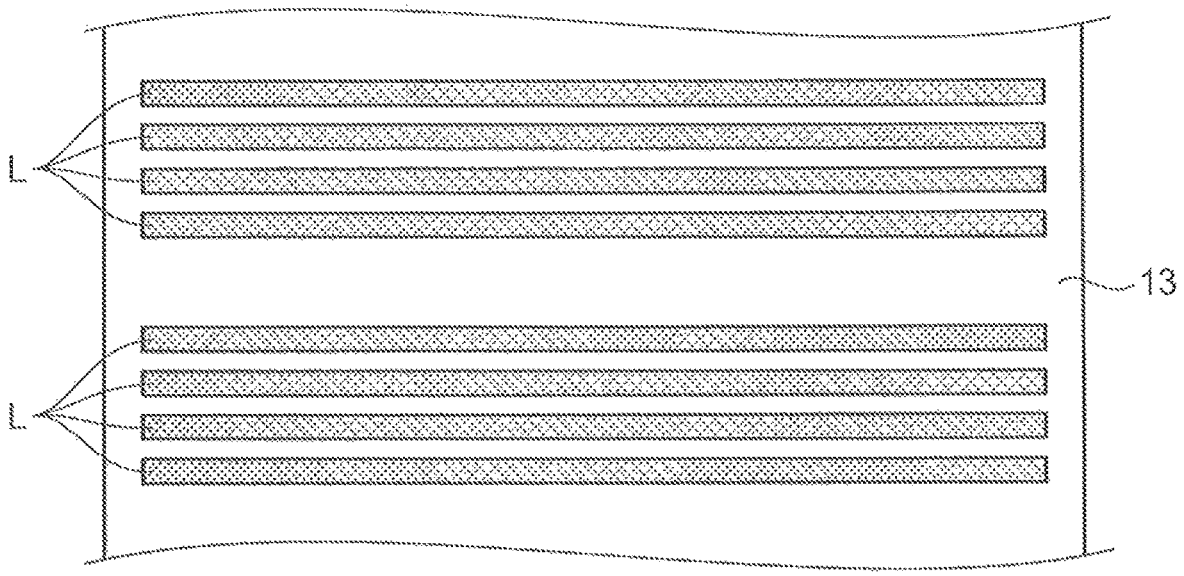
FIG. 26 is a view showing a state where the adhesive agent is applied by coating to the joining end portion.

In this embodiment, as described above, four nozzle holes 406*b* are formed in the nozzle 406. In steps S22 to S24, the nozzle 406 takes the posture where these four nozzle holes 406*b* are arranged side by side along the longitudinal direction of the sheet end portion 13. Accordingly, by performing processing in steps S22 to S24, as shown in FIG. 26, an adhesive agent is applied by coating to the joining end portion 13 along eight lines L.

In this manner, in steps S21 to S24, an adhesive agent discharge step is performed where the nozzle 406 is moved to the standby-side joining mechanism 330 (to be more specific, the temporary holding part 304 of the standby-side joining mechanism 330), and an adhesive agent is discharged from the nozzle part 406 to the joining end portion 13.

Subsequent to step S24, in step S25, the controller 100 stops discharging of the adhesive agent from the nozzle 406 by closing the adhesive agent discharge valve 417. Further, the controller 100 stops driving of the adhesive agent pump 418*b*.

Next, in step S26, the controller 100 returns the head 43*e* to a standby position by driving the operation robot drive motor 401 or the like. Further, the controller 100 returns the sheet end portion gripping part 405 to the first posture A1 by driving the pad rotating mechanism 440.

Figure 27:
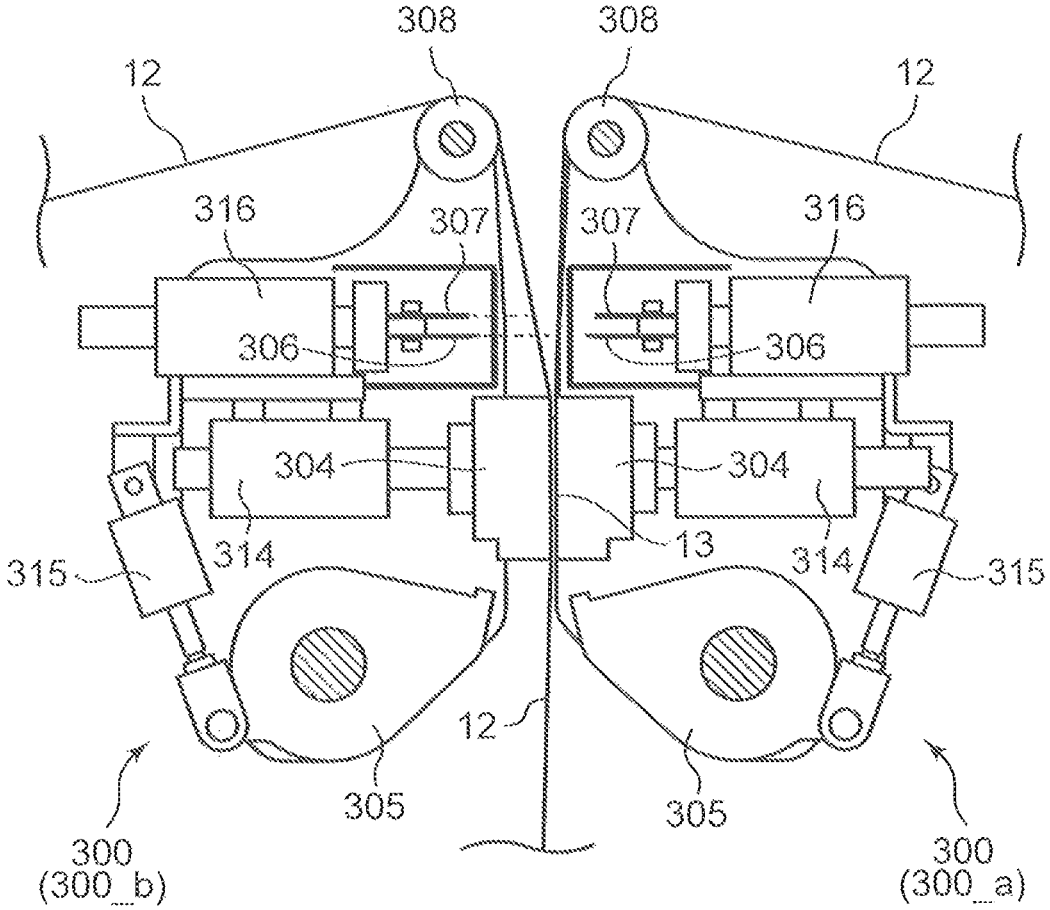
FIG. 27 is a view showing a manner of operation when the joining end portion is adhered to a sheet of a feeding-side original sheet roll.

Next, in step S27, the controller 100 rotates the standby-side joining mechanism 300 to the feeding position as shown in FIG. 27 by driving the joining mechanism rotating valve 302, that is, the joining mechanism rotating cylinder 301.

Next, in step S28, as shown in FIG. 27, the controller 100 pushes the temporary holding part 304 of the feeding-side joining mechanism 300 toward the standby-side joining mechanism 300 thus bringing the sheet 12 on the feeding-side original sheet roll 10 and the joining end portion 13 into close contact with each other. Specifically, the controller 100 pushes the feeding-side temporary holding part 304 by driving the first joining control valve 324 (first joining cylinder 314). By such an operation, the sheet 12 on the feeding-side original sheet roll 10 and the joining end portion 13, that is, the end portion 13 of the sheet 12 on the standby-side original sheet roll 10 are adhered to each other by means of an adhesive agent.

Before performing processing in step S28, the controller 100 rotates the sheet end portion pressing member 305 of the standby-side joining mechanism 300 in a direction away from the temporary holding part 304 thus releasing gripping of the joining end portion 13 by the above-mentioned members.

Further, before performing processing in step S28, the controller 100 separates the upper roller group 24*h*_1 and the lower roller group 24*h*_2 of the sheet retaining mechanism 24*h* from each other in advance and, then, stops the rotation of the roll holding shaft 21 which holds the feeding-side original sheet roll 10 and, at the same time, makes the upper roller group 24*h*_1 and the lower roller group 24*h*_2 of the sheet retaining mechanism 24*h* approach each other. By such an operation, even when the rotation of the feeding-side original sheet roll 10 is stopped, feeding of the sheet 12 is continued.

Next, in step S29, the controller 100 makes the cutting blade 306 of the feeding-side joining mechanism 300 cut the sheet 12 of the feeding-side original sheet roll 10. Specifically, as indicated by a chain line in FIG. 27, the controller 100 pushes the cutting blade 306 and the pressing blade 307 of the feeding-side joining mechanism 300 toward the standby-side joining mechanism 300, and brings the cutting blade 306 into pressure contact with the sheet 12 while pressing the sheet 12 on the feeding-side original sheet roll 10 using the pressing blade 307 thus allowing the cutting blade 306 so as to cut the sheet 12.

Figure 28:
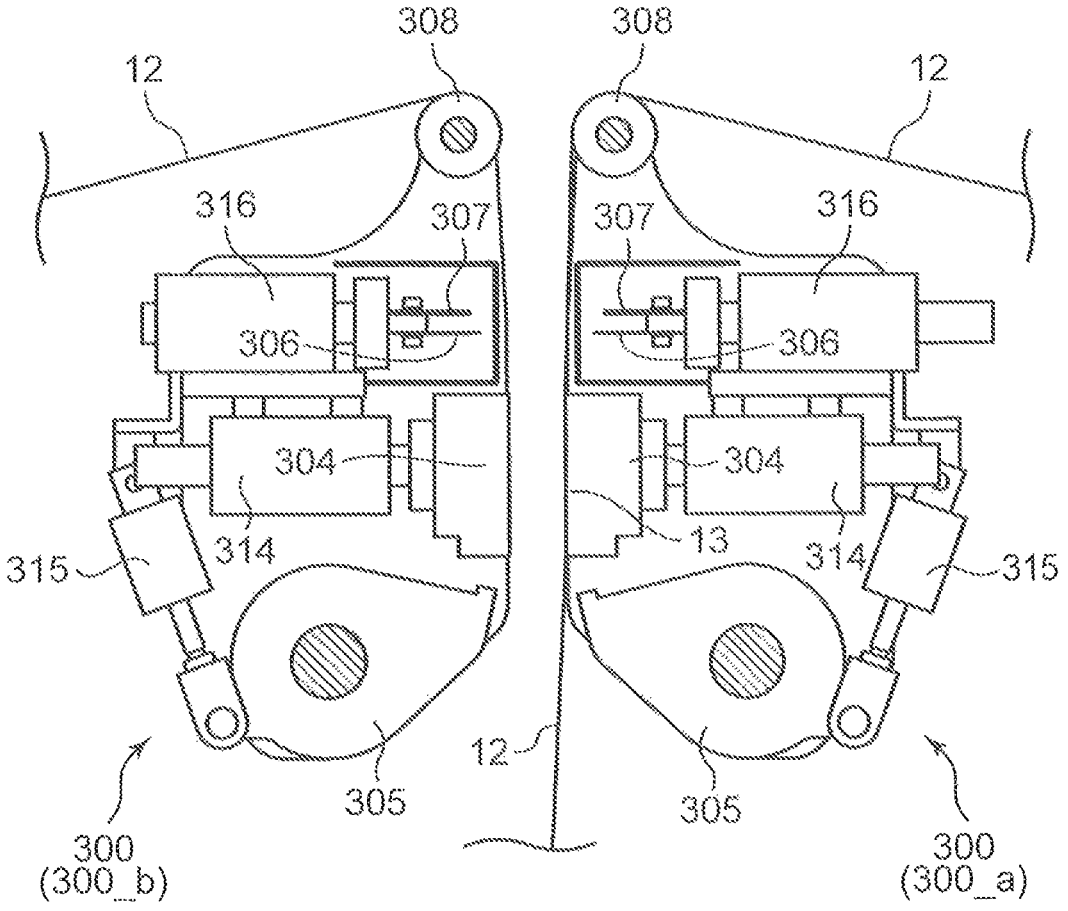
FIG. 28 is a view showing a state after the joining end portion is adhered to the sheet of the feeding-side original sheet roll.

Next, in step S30, the controller 100 returns the temporary holding part 304 of the feeding-side joining mechanism 300 to the original position as shown in FIG. 28.

Due to the above-mentioned steps, as shown in FIG. 28, the end portion 13 of the sheet 12 on the standby-side original sheet roll 10 is joined to the sheet 12 on the feeding-side original sheet roll 10 and, at the same time, the original sheet roll 10 from which the sheet 12 is to be fed is switched.

(4-2) Adhesive Agent Removing Operation

Figure 29:
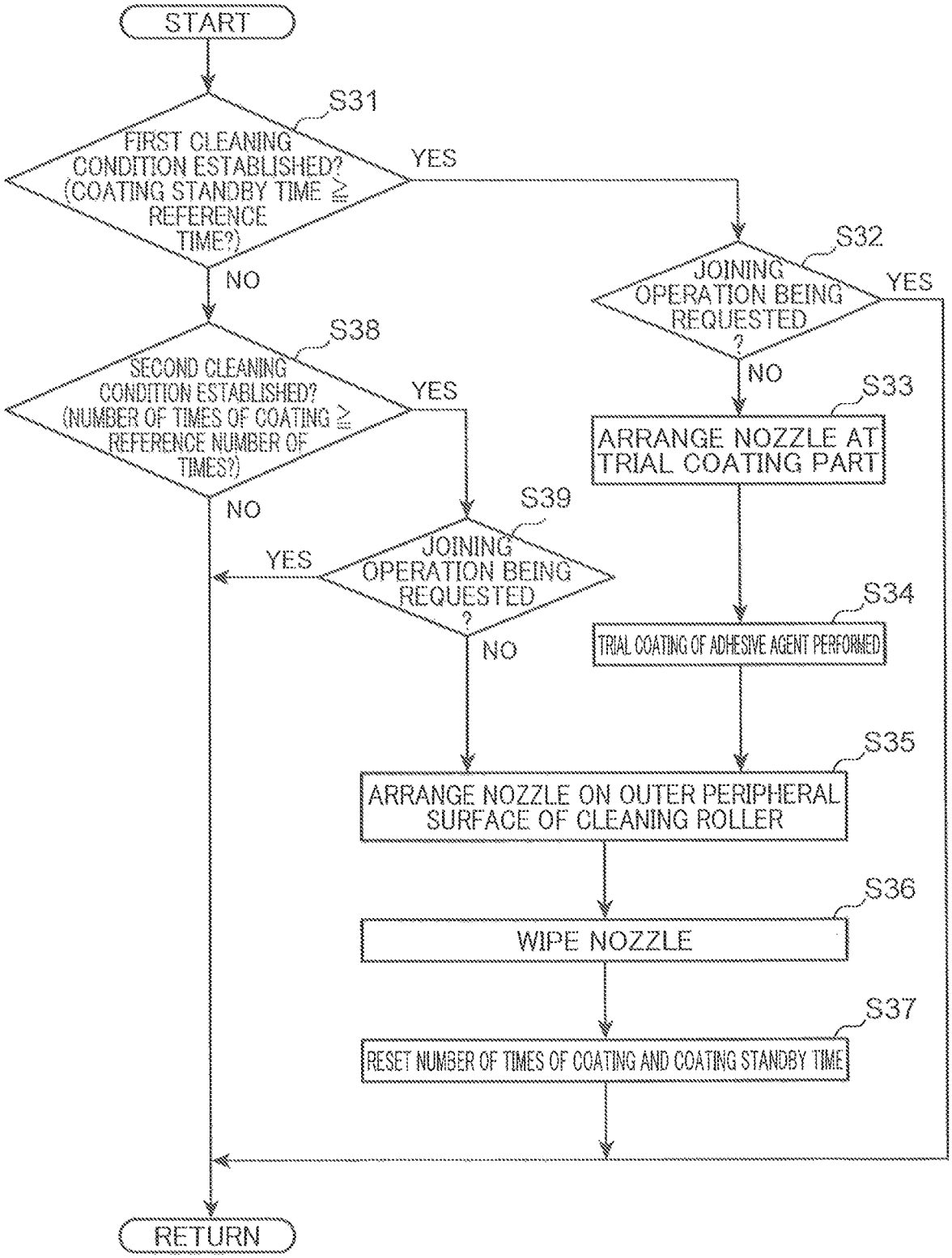
FIG. 29 is a flowchart showing steps of an adhesive agent removing operation.
Figure 30:
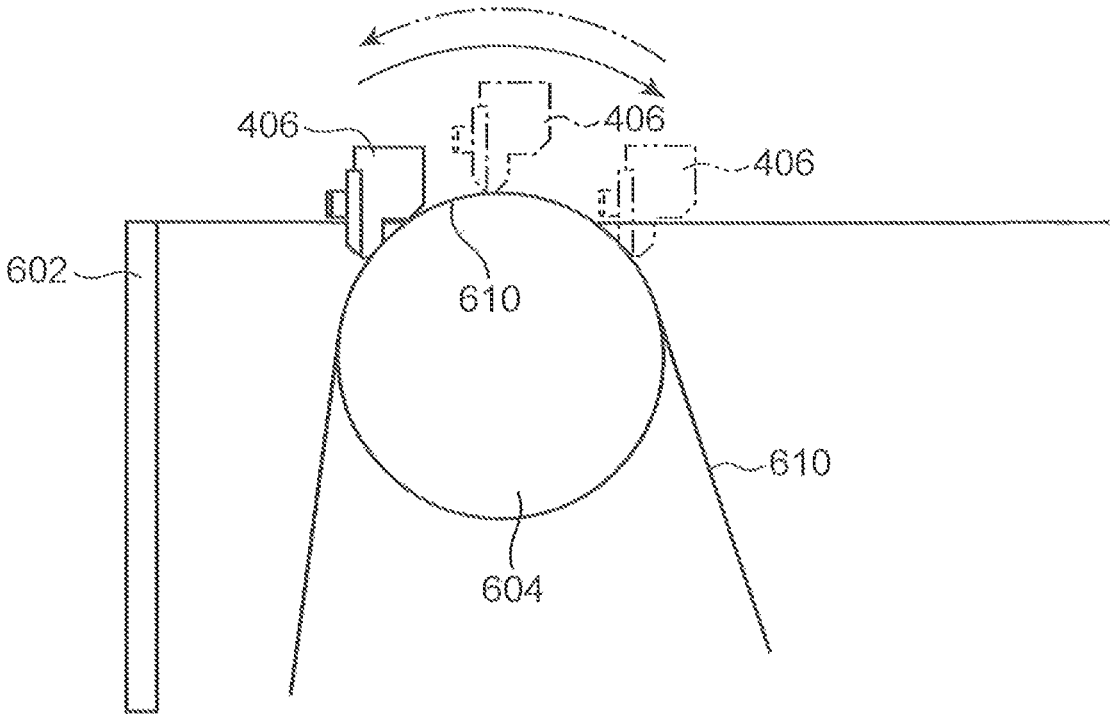
FIG. 30 is a view showing a manner of operation when an adhesive agent adhered to a nozzle is wiped off.

Steps in an adhesive agent removing operation (adhesive agent wiping operation), that is, control (wiping control) performed by the controller 100 (the sheet-feeding device controller 101 and the operation robot controller 102) in the adhesive agent removing operation is described hereinafter with reference to a flowchart shown in FIG. 29, and FIG. 30.

First, in step S31, the controller 100 determines whether or not a first cleaning condition which is one of conditions of determining whether or not the adhesive agent removing operation is to be operated is established. Specifically, the controller 100 determines that the first cleaning condition is established when a coating standby time which is a time elapsed from a point of time that processing in step S36 described later is performed so that the adhesive agent adhered to the nozzle 406 is wiped off or a time elapsed from a point of time that the adhesive agent is applied by coating last without performing processing in step S36 becomes a preset reference time or more. That is, the controller 100 measures the above-mentioned elapsed time, and determines whether or not the elapsed time is equal to or more than the reference time.

When the determination in step S31 is YES so that the coating standby time becomes equal to or more than the reference time and it is determined that the first cleaning condition is established, the controller 100 advances processing to step S32.

In step S32, the controller 100 determines whether or not a joining operation is requested. As described previously, in this embodiment, when a remaining amount of the sheet of the feeding-side original sheet roll 10 becomes equal to or less than the reference sheet amount (determination in step S1 becomes YES), the controller 100 performs the joining operation. Accordingly, in step S32, the controller 100 determines that the joining operation is requested when the remaining amount of the sheet of the feeding-side original sheet roll 10 becomes equal to or less than the reference sheet amount.

When the determination in step S32 is YES so that a joining operation is requested while the first cleaning condition is established, the controller 100 finishes processing as it is without performing an adhesive agent removing operation. In this case, since the determination in step S1 is YES, processing in the respective steps succeeding to step S2 are performed so as to start the joining operation.

On the other hand, when the determination in step S32 is NO so that there is no request for joining operation while the first cleaning condition is established, processing advances to step S33.

In step S33, the controller 100 arranges the nozzle 406 at the discarding part 602*a*.

Specifically, the controller 100 moves the operation robot 4 to the cleaning unit 6 as indicated by a chain line in FIG. 1 by driving the traveling motor 42*a*, the operation robot drive motor 401 or the like. Further, as indicated by a chain line in FIG. 12, the controller 100 moves the head 43*e* and the hand 44 by driving the operation robot drive motor 401 or the like such that the nozzle 406 is brought into a posture where the nozzle 406 protrudes downward from the upright wall 402*b* of the base part 402 at the discarding part 602*a*.

Next, in step S34, the controller 100 performs discarding of an adhesive agent. Specifically, the controller 100 discharges an adhesive agent downward from the nozzle 406 by driving the adhesive agent pump 418*b* and by opening the adhesive agent discharge valve 417. By such an operation, an adhesive agent remaining in the nozzle 406 is removed from the nozzle 406.

As described previously, the discarding part 602*a* is disposed on a portion positioned between the cleaning roller 604 and the wiping sheet winding roller 605 as viewed in a plan view at an opening portion formed on an upper portion of the cleaning unit 6. The wiping sheet 610 is extended between these rollers 604, 605. Accordingly, the adhesive agent which is discharged and falls from the nozzle 406 is received by the wiping sheet 610.

Next, in step S35, the controller 100 moves the nozzle 406 on the outer peripheral surface of the cleaning roller 604. Specifically, the controller 100 moves the head 43*e* by driving the operation robot drive motor 401 or the like such that the nozzle 406 is arranged at the position where the nozzle 406 is brought into contact with the wiping sheet 610 placed on the outer peripheral surface of the upper portion of the cleaning roller 604.

Next, in step S36, the controller 100 performs wiping of the adhesive agent adhering to the nozzle 406. Specifically, the controller 100 moves the nozzle 406 while bringing the nozzle 406 into contact with the wiping sheet 610 placed on the outer peripheral surface of the upper portion of the cleaning roller 604.

In this embodiment, the controller 100 reciprocates the nozzle 406 in the conveyance direction of the wiping sheet 610 while bringing the nozzle 406 into contact with the wiping sheet 610. Specifically, first, as indicated by a solid line in FIG. 30, the controller 100 arranges the nozzle 406 in the vicinity of an upstream-side end portion of the upper portion of the cleaning roller 604 in the conveyance direction of the wiping sheet 610. Then, the controller 100 moves the nozzle 406 to a downstream side in the conveyance direction of the wiping sheet 610 along the outer peripheral surface of the cleaning roller 604 as indicated by an arrow in FIG. 30 drawn by a solid line. When the nozzle 406 reaches an area in the vicinity of the downstream-side end portion of the upper portion of the cleaning roller 604 in the conveyance direction of the wiping sheet 610, the controller 100 moves the nozzle 406 toward an upstream side in the conveyance direction of the wiping sheet 610. During such reciprocation of the nozzle 406, the controller 100 moves the nozzle 406 such that the coating surface 406*a* of the nozzle 406 is constantly brought into contact with the wiping sheet 610.

In this manner, by moving the nozzle 406 in a state where the coating surface 406*a* of the nozzle 406 is brought into contact with the wiping sheet 610, the adhesive agent adhering to the coating surface 406*a* of the nozzle 406 is wiped off by the wiping sheet 610.

Next, in step S37, the controller 100 resets the number of times of coating and the coating standby time described later, and finishes the processing. In this embodiment, at this stage of operation, the controller 100 returns the head 43*e* to the standby position. Further, the controller 100 feeds the wiping sheet 610 by rotating the draw roller 607 with driving of the rotatably driving part 606. At the same time, the controller 100 makes the wiping sheet winding roller 605 wind the wiping sheet 610 by rotating the wiping sheet winding roller 605. By such an operation, the wiping sheet 610 used in wiping off the adhesive agent is wound by the wiping sheet winding roller 605, and a new wiping sheet 610 to which an adhesive agent is not adhered is arranged on the outer peripheral surface of the cleaning roller 604.

On the other hand, when the controller 100 determines that the determination in step S31 is NO and the first cleaning condition is not established, processing advances to step S38.

In step S38, the controller 100 determines whether or not a second cleaning condition which is one of determination conditions for determining whether or not the adhesive agent removing operation is to be performed is established. Specifically, when the number of times of coating which is the number of times that a coating operation of an adhesive agent is performed becomes equal to or more than the preset reference number of times, it is determined that the second cleaning condition is established. That is, the controller 100 counts up the number of times that a coating operation of an adhesive agent is performed, for example, the number of times that processing in step S22 is performed or the number of times that processing in step S25 is performed, and determines whether or not such number of times is equal to or more than the reference number of times.

As described previously, the number of times of coating is reset in step S37 when processing in step S36 is performed (the number of times of coating being returned to 0).

When the determination in step S38 is YES, processing advances to step S39. In step S39, in the same manner as in step S32, the controller 100 determines whether or not a joining operation is requested. When the determination in step S38 is YES and the determination in step S39 is YES, that is, when the second cleaning condition is established and a joining operation is requested, the controller 100 finishes processing as it is without performing the adhesive agent removing operation (processing succeeding to step S2 being performed). Also, when the determination in step S38 is NO, processing is finished as it is.

On the other hand, when the determination in step S38 is YES so that the second cleaning condition is established, and the determination in step S39 is NO so that there is no request of a joining operation, processing advances to step S35. Then, processing in steps S35 to S37 are performed and are finished.

In this manner, in this embodiment, in the case where a joining operation is requested, even when the first cleaning condition or the second cleaning condition is established, the joining operation is performed prior to the cleaning operation. On the other hand, in the case where a joining operation is not requested, when the first cleaning condition or the second cleaning condition is established, wiping off of the nozzle 406 is performed. With such a cleaning operation, the adhesive agent remaining on the coating surface 406*a* of the nozzle 406 is removed so that the coating surface 406*a* is maintained cleanly and hence, in a joining operation, an adhesive agent is favorably applied by coating to the joining end portion 13. Particularly, when the first cleaning condition is established, discarding of an adhesive agent is performed. By such an operation, an adhesive agent which remains in the nozzle holes 406*b* formed in the nozzle 406 and the adhesive agent supply passage 406*c* for a reference time and may be degraded is removed. Accordingly, in a joining operation, the sheet 12 on the feeding-side original sheet roll 10 and the end portion 13 of the sheet 12 on the standby-side original sheet roll 10 are favorably adhered to each other.

(5) Manner of Operation and the Like

As has been described above, in the sheet-feeding system 1 according to this embodiment, the joining part 30 for joining the joining end portion 13 which is the end portion 13 of the sheet 12 on the standby-side original sheet roll 10 is provided to the middle portion of the sheet 12 on the feeding-side original sheet roll 10. Further, when a remaining amount of the sheet 12 on the feeding-side original sheet roll 10 becomes equal to or less than a reference sheet amount, the joining end portion 13 on the standby-side original sheet roll 10 is conveyed to the joining part 30 by the operation robot 4, and is joined to the sheet 12 on the feeding-side original sheet roll 10. Accordingly, it is possible to feed the sheets 12 on at least two original sheet rolls 10 automatically and continuously thus enhancing operation efficiency.

Further, the sheet-feeding system 1 is provided with the operation robot 4 which includes the sheet end portion gripping part 405 having the holding pads 410 which can perform the sucking of the sheet 12. By bringing the holding surfaces 412*a* of the holding pads 410 into pressure contact with the joining end portion 13 and by performing sucking, the joining end portion 13 can be taken out from the original sheet roll 10. Accordingly, the joining end portion 13 can be taken out with certainty without causing clogging of the joining end portion 13 between the holding pads 410 and the original sheet roll 10. Further, the joining end portion 13 can be held by sandwiching the joining end portion 13 with the pair of holding pads 410, and the joining end portion 13 can be conveyed to the joining portion 30 in such a holding state. Accordingly, the joining end portion 13 can be held in a stable manner, and the joining end portion 13 can be conveyed to the joining end portion 13 with more certainty. Accordingly, operation efficiency can be enhanced.

Particularly, in the above-mentioned embodiment, processing in step S8 is performed before the holding surface 412*a* which sucks the joining end portion 13 in step S9 and the joining end portion 13 are separated from the standby-side original sheet roll 10, and the standby-side original sheet roll 10 is rotatably driven in the feeding direction of the sheet 12. Further, the roll holding shaft drive motor 22 is driven at a feeding speed such that a tension applied to the sheet 12 becomes equal to or less than the predetermined tension.

Accordingly, it is possible to suppress the occurrence of a phenomenon that when the joining end portion 13 is separated from the standby-side original sheet roll 10, a tension applied to the sheet 12 on the standby-side original sheet roll 10 is excessively increased so that the joining end portion 13 is separated from the holding surface 412*a*. Accordingly, the joining end portion 13 can be conveyed to the joining part 30 with more certainty.

Further, in the above-mentioned embodiment, when the holding pads 410 are brought into the second posture A2 from the first posture A1 and the joining end portion 30 is sandwiched between the holding pads 410, the holding surface 412*a* of the holding pad 410 which does not suck the joining end portion 30 move along the path reaching a back surface of the joining end portion 13 from the position downstream of the joining end portion 13 toward an upstream side in the sheet-feeding direction of the standby-side original sheet roll 10. Accordingly, during a period that the holding pad 410 which does not suck the joining end portion 30 reaches the back surface of the joining end portion 13, it is possible to avoid the interference between the holding pad 410 and the sheet 12. Accordingly, it is possible to make the holding pads 410 properly sandwich the joining end portion 13 while suppressing the occurrence of a breakage or the like of the sheet 12 attributed to such an interference.

In the above-mentioned embodiment, the holding surfaces 412*a* of both holding pads 410 can suck the sheet end portion 13 respectively and, at the same time, the hand 44 is rotatable about the fifth axis J5. Accordingly, the holding pad 410 for taking out the joining end portion 13 by sucking the joining end portion 13 can be suitably changed between two holding pads 410 corresponding to the position of the joining end portion 13, the rotation direction of the standby-side original sheet roll 10 or the like. Accordingly, the joining end portion 13 can be properly taken out by bringing the holding surface 412*a* of the holding pad 410 into pressure contact with the outer peripheral surface of the standby-side original sheet roll 10 in a more proper posture.

Figure 31:
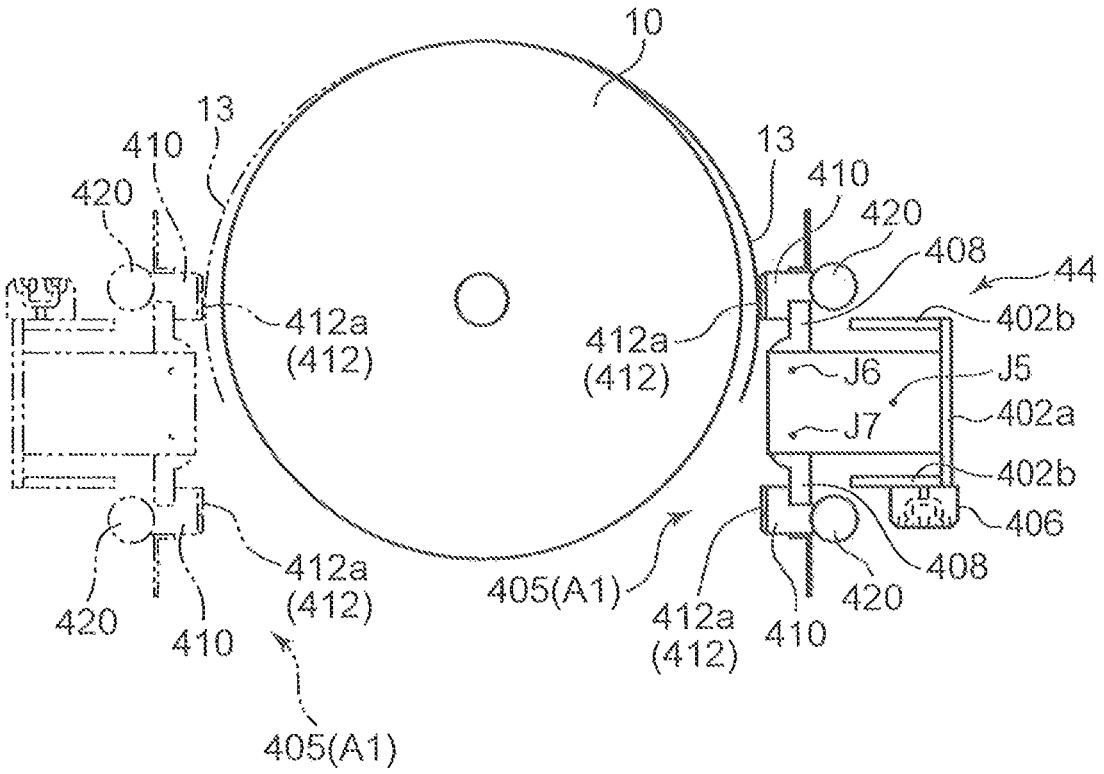
FIG. 31 is a view showing a posture of a hand at the time of sucking a sheet according to another example.

For example, as indicated by a chain line and a solid line in FIG. 31, even when the feeding directions of the sheets 12 differ, by rotating the hand 44 about the fifth axis J5, it is possible to make the holding surface 412*a* of either one of the holding pads 410 correspond to the position of the joining end portion 13 so that the joining end portion 13 can be properly sucked to the holding pad 410. Also in the above-mentioned embodiment, in the case where a standby-side original sheet roll is formed of the left original sheet roll 10 in FIG. 16, the hand 44 is brought into a posture indicated by a solid line in FIG. 31, and the end portion 13 of the sheet 12 on the left original sheet roll 10 is sucked to the upper holding pad 410.

(6) Modification

In the above-mentioned embodiment, the description has been made with respect to the case where, before processing in step S9 (the step of separating the holding surface 412*a* which sucks the joining end portion 13 and the joining end portion 13 from the standby-side original sheet roll 10) is performed, processing in step S8 (the step of rotatably driving the standby-side original sheet roll 10 in the feeding direction of the sheet 12) is performed. However, the processing in steps S8, S9 may be performed simultaneously. Also in this case, a tension applied to the sheet 12 on the standby-side original sheet roll 10 can be suppressed at a low level and hence, it is possible to suppress the occurrence of a breakage of the sheet 12 and a phenomenon that the joining end portion 13 is separated from the holding surface 412*a*.

The specific embodiments described above mainly include the inventions having the following configurations.

The present invention is directed to a sheet-feeding system for continuously feeding a sheet, the sheet-feeding system including: a roll holding part configured such that a pair of original sheet rolls around which sheets are respectively wound is held in a rotatable state thus enabling feeding of the sheets; a joining part configured such that, with respect to the pair of original sheet rolls, to a middle portion of the sheet of one original sheet roll from which the sheet is fed, a joining end portion which is an end portion of the sheet of the other original sheet roll from which the sheet is not fed is joined; a remaining sheet amount detection unit for detecting a remaining amount of the sheet of the one original sheet roll; an end portion holding device having: a holding unit capable of holding the joining end portion; and a moving mechanism capable of moving the holding unit between the other original sheet roll and the joining part; and a controller for controlling the end portion holding device, in which the holding unit has: a pair of holding pads having a holding surface respectively; a support part for supporting the pair of holding pads; a suction mechanism capable of making the holding surface of at least one holding pad out of the pair of holding pads suck the joining end portion; and a sandwiching mechanism capable of changing a posture of the pair of holding pads with respect to the support part between a first posture where the holding surfaces of the pair of holding pads are opened so as to enable pressing of the holding surface of the one holding pad to the joining end portion from an outside of the other original sheet roll in a radial direction of the other original sheet roll and a second posture where the holding surfaces of the pair of holding pads are made closer to each other so as to enable sandwiching of the joining end portion by the holding surfaces of the pair of holding pads, the controller is configured to control, in a case where a sheet joining condition where a remaining amount of the sheet of the one original sheet roll is equal to or less than a predetermined remaining amount is established, the moving mechanism, the suction mechanism, and the sandwiching mechanism so as to move the holding unit such that, in a state where the pair of holding pads is in the first posture, the holding surface of the one holding pad is pressed to the joining end portion from the outside of the other original sheet roll in the radial direction, to move the holding unit while holding the joining end portion to the holding surface of the one holding pad by suction such that the joining end portion is separated toward the outside of the other original sheet roll in the radial direction, and to move the holding unit such that the joining end portion is conveyed to the joining part in a state where the joining end portion is sandwiched by the holding surfaces of the pair of holding pads by changing the posture of the pair of holding pads from the first posture to the second posture.

With such a configuration, the joining part for joining the joining end portion which is the end portion of the sheet of the other original sheet roll to the middle portion of the sheet of one original sheet roll is provided and, at the same time, when the remaining amount of the sheet of one original sheet roll held on the roll holding part becomes equal to or less than the predetermined remaining amount, the joining end portion of the other original sheet roll is conveyed to the joining part by the end portion holding device. Accordingly, it is possible to feed sheets on at least two original sheet rolls automatically and continuously thus enhancing operation efficiency.

Further, in the above-mentioned configuration, the holding unit is provided, and the joining end portion is taken out from the original sheet roll by pressing the holding surface of one holding pad of the holding unit to the joining end portion and by sucking the joining end portion to the holding surface of the holding pad. Then, the joining end portion is held by sandwiching the joining end portion between the holding surface of one holding pad and the holding surface of the other holding pad, and the joining end portion is conveyed to the joining part. Accordingly, at the time of taking out the joining end portion, the joining end portion can be taken out from the original sheet roll with certainty without causing clogging of the sheet between the holding pad and the original sheet roll so that the joining end portion can be conveyed to the joining part. Accordingly, the operation efficiency can be enhanced with more certainty.

In the above-mentioned configuration, it is preferable that the sheet-feeding system include a drive part for rotating the other original sheet roll in a feeding direction of the sheet of the other original sheet roll, in which the controller be configured to control the drive part such that, before or simultaneously with the control for moving the holding unit while holding the joining end portion to the holding surface of the one holding pad by suction so as to separate the joining end portion toward the outside of the other original sheet roll in the radial direction, the other original sheet roll is rotated at a feeding speed of the sheet such that a tension applied to the sheet of the other original sheet roll becomes a predetermined tension or less.

With such a configuration, it is possible to suppress the occurrence of a phenomenon that, when the joining end portion is sucked to the holding surface of the holding pad and is separated from the original sheet roll, the tension applied to the sheet of the original sheet roll becomes excessively large so that the joining end portion is separated from the holding surface. Accordingly, the joining end portion can be further properly conveyed to the joining part.

In the above-mentioned configuration, it is preferable that the joining end portion include a first surface directed toward the outside of the other original sheet roll in the radial direction, and a second surface directed toward an inside of the other original sheet roll in the radial direction, in a state where the first surface of the joining end portion is sucked to the holding surface of the one holding pad, a moving path of the holding surface of the other holding pad with respect to the holding surface of the one holding pad include a path reaching the second surface of the joining end portion toward an upstream in a feeding direction of the sheet of the other original sheet roll from a position downstream of the joining end portion in the feeding direction of the sheet of the other original sheet roll, and the controller be configured to change the posture of the pair of holding pads from the first posture to the second posture by moving the holding surface of the other holding pad with respect to the holding surface of the one holding pad along the moving path.

With such a configuration, when the other holding pad (a holding pad different from the holding pad which sucks the first surface of the joining end portion) is moved to the second surface of the joining end portion, it is possible to suppress the occurrence of interference between the other holding pad and the sheet. Accordingly, it is possible to suppress the separation of the joining part from the holding part attributed to the interference thus properly sandwiching the joining end portion by the holding pads.

In the above-mentioned configuration, it is preferable that the suction mechanism be configured to enable the respective holding surfaces of the pair of holding pads to suck the joining end portion, the moving mechanism rotatably hold the support part about a rotation center axis, the support part support the respective holding pads such that the holding surfaces of the respective holding pads respectively extend along a direction parallel to the rotation center axis, and the sandwiching mechanism be configured to change the posture of the pair of holding pads between the first posture where the holding surfaces of the pair of holding pads are respectively separated from each other about the rotation center axis and the second posture.

With such a configuration, the holding surface for sucking the joining end portion can be suitably changed between the holding surfaces of the pair of holding pads and, at the same time, directions of the holding surfaces of the respective holding pads can be easily changed. Accordingly, by changing the holding surface and the direction of the holding surface corresponding to a position of the joining end portion, the rotating direction of the original sheet roll and the like, the holding surface of the holding pad can be brought into pressure contact with the outer peripheral surface of the original sheet roll with the more suitable posture thus allowing the holding surface to suck the joining end portion more properly.

Further, the present invention is directed to a sheet-feeding method for continuously feeding a sheet using a sheet-feeding system, in which the sheet-feeding system includes: a roll holding part configured such that a pair of original sheet rolls around which sheets are respectively wound is held in a rotatable state thus enabling feeding of the sheets; a joining part configured such that, with respect to the pair of original sheet rolls, to a middle portion of the sheet of one original sheet roll from which the sheet is fed, a joining end portion which is an end portion of the sheet of the other original sheet roll from which the sheet is not fed is joined; and an end portion holding device having: a holding unit capable of holding the joining end portion; and a moving mechanism for moving the holding unit between the other original sheet roll and the joining part, and the holding unit has: a pair of holding pads having a holding surface respectively; a support part for supporting the pair of holding pads; a suction mechanism capable of making the holding surface of at least one holding pad out of the pair of holding pads suck the joining end portion; and a sandwiching mechanism capable of changing a posture of the pair of holding pads with respect to the support part between a first posture where the holding surfaces of the pair of holding pads are opened so as to enable pressing of the holding surface of the one holding pad to the joining end portion from an outside of the other original sheet roll in a radial direction of the other original sheet roll and a second posture where the holding surfaces of the pair of holding pads are made closer to each other so as to enable sandwiching of the joining end portion by the holding surfaces of the pair of holding pads, and the sheet-feeding method including steps of: in a case where a sheet joining condition where a remaining amount of the sheet of the one original sheet roll is equal to or less than a predetermined remaining amount is established, moving the holding unit such that, in a state where the pair of holding pads is in the first posture, the holding surface of the one holding pad is pressed to the joining end portion from the outside of the other original sheet roll in the radial direction; moving the holding unit while holding the joining end portion to the holding surface of the one holding pad by suction such that the joining end portion is separated toward the outside of the other original sheet roll in the radial direction; and moving the holding unit such that the joining end portion is conveyed to the joining part in a state where the joining end portion is sandwiched by the holding surfaces of the pair of holding pads by changing the posture of the pair of holding pads from the first posture to the second posture.

With such a method, the joining part for joining the joining end portion which is the end portion of the sheet of the other original sheet roll to the middle portion of the sheet of one original sheet roll is provided and, at the same time, when the remaining amount of the sheet of one original sheet roll held on the roll holding part becomes equal to or less than the predetermined remaining amount, the joining end portion of the other original sheet roll is conveyed to the joining part by the end portion holding device. Accordingly, it is possible to feed sheets on at least two original sheet rolls automatically and continuously thus enhancing operation efficiency.

Further, in this method, the joining end portion is taken out from the original sheet roll by allowing the holding surface of one holding pad of the holding unit to suck the joining end portion by bringing the holding surface of the holding pad into pressure contact with the joining end portion, and then the joining end portion is held by sandwiching the joining end portion between the holding surface of one holding pad and the holding surface of the other holding pad, and the joining end portion is conveyed to the joining part. Accordingly, it is possible to take out the joining end portion from the original sheet roll with more certainty, and the joining end portion can be conveyed to the joining part.

Accordingly, operation efficiency can be enhanced with more certainty.

The invention claimed is:

1. A sheet-feeding system for continuously feeding a sheet, the sheet-feeding system comprising:

a roll holding part configured such that a first original sheet roll and a second original sheet roll around which sheets are respectively wound are held in a rotatable state thus enabling feeding of the sheets;

a joining part configured such that, with respect to the first original sheet roll and the second original sheet roll, to a middle portion of the sheet of the first original sheet roll from which the sheet is fed, a joining end portion which is an end portion of the sheet of the second original sheet roll from which the sheet is not fed is joined;

a remaining sheet amount detection unit for detecting a remaining amount of the sheet of the first original sheet roll;

an end portion holding device having: a holding unit capable of holding the joining end portion; and a moving mechanism capable of moving the holding unit between the second original sheet roll and the joining part;

a controller for controlling the end portion holding device; and a drive part for rotating the second original sheet roll in a feeding direction of the sheet of the second original sheet roll, wherein the holding unit has: a first holding pad and a second holding pad each having a holding surface; a support part for supporting the first holding pad and the second holding pad; a suction mechanism capable of making the holding surface of at least the first holding pad suck the joining end portion; and a sandwiching mechanism capable of changing a posture of the first holding pad and the second holding pad with respect to the support part between a first posture where the holding surfaces of the first holding pad and the second holding pad are opened so as to enable pressing of the holding surface of the first holding pad to the joining end portion from an outside of the second original sheet roll in a radial direction of the second original sheet roll and a second posture where the holding surfaces of the first holding pad and the second holding pad are closer to each other so as to enable sandwiching of the joining end portion by the holding surfaces of the first holding pad and the second holding pad, the controller is configured to control, in a case where a sheet joining condition where a remaining amount of the sheet of the first original sheet roll is equal to or less than a predetermined remaining amount is established, the moving mechanism, the suction mechanism, and the sandwiching mechanism so as to move the holding unit such that, in a state where the first holding pad and the second holding pad are in the first posture, the holding surface of the first holding pad is pressed to the joining end portion from the outside of the second original sheet roll in the radial direction, move the holding unit, in the state where the first holding pad and the second holding pad are in the first posture, while holding the joining end portion to the holding surface of the first holding pad by suction such that the joining end portion is separated toward the outside of the second original sheet roll in the radial direction, and move the holding unit such that, after the first holding pad to which the joining end portion is sucked is separated toward the outside of the second original sheet roll in the radial direction, the joining end portion is conveyed to the joining part in a state where the joining end portion is sandwiched by the holding surfaces of the first holding pad and the second holding pad by changing the posture of the first holding pad and the second holding pad from the first posture to the second posture, and the controller is configured to control the drive part such that, before or simultaneously with the control for moving the holding unit, in the state where the first holding pad and the second holding pad are in the first posture, while holding the joining end portion to the holding surface of the first holding pad by suction so as to separate the joining end portion toward the outside of the second original sheet roll in the radial direction, the second original sheet roll is rotated at a feeding speed of the sheet such that a tension applied to the sheet of the second original sheet roll becomes a predetermined tension or less.

2. The sheet-feeding system according to claim 1, wherein the joining end portion includes a first surface directed toward the outside of the second original sheet roll in the radial direction, and a second surface directed toward an inside of the second original sheet roll in the radial direction, in a state where the first surface of the joining end portion is sucked to the holding surface of the first holding pad, a moving path of the holding surface of the second holding pad with respect to the holding surface of the first holding pad includes a path reaching the second surface of the joining end portion toward an upstream in the feeding direction of the sheet of the second original sheet roll from a position downstream of the joining end portion in the feeding direction of the sheet of the second original sheet roll, and the controller is configured to change the posture of the first holding pad and the second holding pad from the first posture to the second posture by moving the holding surface of the second holding pad with respect to the holding surface of the first holding pad along the moving path.

3. The sheet-feeding system according to claim 2, wherein the suction mechanism is configured to enable the holding surfaces of the first holding pad and the second holding pad to suck the joining end portion, the moving mechanism rotatably holds the support part about a rotation center axis, the support part supports the first holding pad and the second holding pad such that each of the holding surfaces of the first holding pad and the second holding pad extends along a direction parallel to the rotation center axis, and the sandwiching mechanism is configured to change the posture of the first holding pad and the second holding pad between the first posture where the holding surfaces of the first holding pad and the second holding pad are separated from each other about the rotation center axis and the second posture.

4. The sheet-feeding system according to claim 1, wherein the suction mechanism is configured to enable the holding surfaces of the first holding pad and the second holding pad to suck the joining end portion, the moving mechanism rotatably holds the support part about a rotation center axis, the support part supports the first holding pad and the second holding pad such that each of the holding surfaces of the first holding pad and the second holding pad extends along a direction parallel to the rotation center axis, and the sandwiching mechanism is configured to change the posture of the first holding pad and the second holding pad between the first posture where the holding surfaces of the first holding pad and the second holding pad are separated from each other about the rotation center axis and the second posture.

5. A sheet-feeding method for continuously feeding a sheet using a sheet-feeding system, wherein the sheet-feeding system comprises:

a roll holding part configured such that a first original sheet roll and a second original sheet roll around which sheets are respectively wound are held in a rotatable state thus enabling feeding of the sheets;

a joining part configured such that, with respect to the first original sheet roll and the second original sheet roll, to a middle portion of the sheet of the first original sheet roll from which the sheet is fed, a joining end portion which is an end portion of the sheet of the second original sheet roll from which the sheet is not fed is joined;

an end portion holding device having: a holding unit capable of holding the joining end portion; and a moving mechanism capable of moving the holding unit between the second original sheet roll and the joining part; and a drive part for rotating the second original sheet roll in a feeding direction of the sheet of the second original sheet roll, and the holding unit has: a first holding pad and a second holding pad each having a holding surface; a support part for supporting the first holding pad and the second holding pad; a suction mechanism capable of making the holding surface of at least the first holding pad suck the joining end portion; and a sandwiching mechanism capable of changing a posture of the first holding pad and the second holding pad with respect to the support part between a first posture where the holding surfaces of the first holding pad and the second holding pad are opened so as to enable pressing of the holding surface of the first holding pad to the joining end portion from an outside of the second original sheet roll in a radial direction of the second original sheet roll and a second posture where the holding surfaces of the first holding pad and the second holding pad are closer to each other so as to enable sandwiching of the joining end portion by the holding surfaces of the first holding pad and the second holding pad, and the sheet-feeding method comprises:

in a case where a sheet joining condition where a remaining amount of the sheet of the first original sheet roll is equal to or less than a predetermined remaining amount is established, moving the holding unit such that, in a state where the first holding pad and the second holding pad are in the first posture, the holding surface of the first holding pad is pressed to the joining end portion from the outside of the second original sheet roll in the radial direction;

moving the holding unit, in the state where the first holding pad and the second holding pad in the first posture, while holding the joining end portion to the holding surface of the first holding pad by suction such that the joining end portion is separated toward the outside of the second original sheet roll in the radial direction;

rotating the second original sheet roll at a feeding speed of the sheet such that a tension applied to the sheet of the second original sheet roll becomes a predetermined tension or less, before or simultaneously with moving the holding unit, in the state where the first holding pad and the second holding pad are in the first posture, while holding the joining end portion to the holding surface of the first holding pad by suction such that the joining end portion is separated toward the outside of the second original sheet roll in the radial direction; and moving the holding unit such that, after the first holding pad to which the joining end portion is sucked is separated toward the outside of the second original sheet roll in the radial direction, the joining end portion is conveyed to the joining part in a state where the joining end portion is sandwiched by the holding surfaces of the first holding pad and the second holding pad by changing the posture of the first holding pad and the second holding pad from the first posture to the second posture.

6. A sheet-feeding system for continuously feeding a sheet, the sheet-feeding system comprising:

a roll holding part configured such that a first original sheet roll and a second original sheet roll around which sheets are respectively wound are held in a rotatable state thus enabling feeding of the sheets;

a joining part configured such that, with respect to the first original sheet roll and the second original sheet roll, to a middle portion of the sheet of the first original sheet roll from which the sheet is fed, a joining end portion which is an end portion of the sheet of the second original sheet roll from which the sheet is not fed is joined;

a remaining sheet amount detection unit for detecting a remaining amount of the sheet of the first original sheet roll;

an end portion holding device having: a holding unit capable of holding the joining end portion; and a moving mechanism capable of moving the holding unit between the second original sheet roll and the joining part, a drive part for rotating the second original sheet roll in a feeding direction of the sheet of the second original sheet roll, and a controller for controlling the end portion holding device, wherein the holding unit has: a first holding pad and a second holding pad each having a holding surface; a support part for supporting the first holding pad and the second holding pad; a suction mechanism capable of making the holding surface of at least the first holding pad suck the joining end portion; and a sandwiching mechanism capable of changing a posture of the first holding pad and the second holding pad with respect to the support part between a first posture where the holding surfaces of the first holding pad and the second holding pad are opened so as to enable pressing of the holding surface of the first holding pad to the joining end portion from an outside of the second original sheet roll in a radial direction of the second original sheet roll and a second posture where the holding surfaces of the first holding pad and the second holding pad are closer to each other so as to enable sandwiching of the joining end portion by the holding surfaces of the first holding pad and the second holding pad, the controller is configured to control, in a case where a sheet joining condition where a remaining amount of the sheet of the first original sheet roll is equal to or less than a predetermined remaining amount is established, the moving mechanism, the suction mechanism, and the sandwiching mechanism so as to move the holding unit such that, in a state where the first holding pad and the second holding pad are in the first posture, the holding surface of the first holding pad is pressed to the joining end portion from the outside of the second original sheet roll in the radial direction, move the holding unit while holding the joining end portion to the holding surface of the first holding pad by suction such that the joining end portion is separated toward the outside of the second original sheet roll in the radial direction, and move the holding unit such that the joining end portion is conveyed to the joining part in a state where the joining end portion is sandwiched by the holding surfaces of the first holding pad and the second holding pad by changing the posture of the first holding pad and the second holding pad from the first posture to the second posture, and the controller is configured to control the drive part such that, before or simultaneously with the control for moving the holding unit while holding the joining end portion to the holding surface of the first holding pad by suction so as to separate the joining end portion toward the outside of the second original sheet roll in the radial direction, the second original sheet roll is rotated at a feeding speed of the sheet such that a tension applied to the sheet of the second original sheet roll becomes a predetermined tension or less.

7. The sheet-feeding system according to claim 6, wherein the joining end portion includes a first surface directed toward the outside of the second original sheet roll in the radial direction, and a second surface directed toward an inside of the second original sheet roll in the radial direction, in a state where the first surface of the joining end portion is sucked to the holding surface of the first holding pad, a moving path of the holding surface of the second holding pad with respect to the holding surface of the first holding pad includes a path reaching the second surface of the joining end portion toward an upstream in a feeding direction of the sheet of the second original sheet roll from a position downstream of the joining end portion in the feeding direction of the sheet of the second original sheet roll, and the controller is configured to change the posture of the first holding pad and the second holding pad from the first posture to the second posture by moving the holding surface of the second holding pad with respect to the holding surface of the first holding pad along the moving path.

8. The sheet-feeding system according to claim 7, wherein the suction mechanism is configured to enable the holding surfaces of the first holding pad and the second holding pad to suck the joining end portion, the moving mechanism rotatably holds the support part about a rotation center axis, the support part supports the first holding pad and the second holding pad such that each of the holding surfaces of the first holding pad and the second holding pad extends along a direction parallel to the rotation center axis, and the sandwiching mechanism is configured to change the posture of the first holding pad and the second holding pad between the first posture where the holding surfaces of the first holding pad and the second holding pad are separated from each other about the rotation center axis and the second posture.

9. The sheet-feeding system according to claim 6, wherein the suction mechanism is configured to enable the holding surfaces of the first holding pad and the second holding pad to suck the joining end portion, the moving mechanism rotatably holds the support part about a rotation center axis, the support part supports the first holding pad and the second holding pad such that each of the holding surfaces of the first holding pad and the second holding pad extends along a direction parallel to the rotation center axis, and the sandwiching mechanism is configured to change the posture of the first holding pad and the second holding pad between the first posture where the holding surfaces of the first holding pad and the second holding pad are separated from each other about the rotation center axis and the second posture.

* * * * *